US006062680A

United States Patent [19]

Yoshihira et al.

[11] Patent Number: 6,062,680

[45] Date of Patent: May 16, 2000

[54] LIQUID EJECTION HEAD AND APPARATUS AND LIQUID EJECTION METHOD

[75] Inventors: Aya Yoshihira, Yokohama; Toshio Kashino, Chigasaki; Takeshi Okazaki, Sagamihara; Kiyomitsu Kudo, Kawasaki; Yoshie Asakawa, Nagano-ken, all of Japan

[73] Assignee: Canon Kabushiki Kaisha, Tokyo, Japan

[21] Appl. No.: 08/710,717

[22] Filed: Sep. 20, 1996

[30] Foreign Application Priority Data

Sep. 22, 1995 [JP] Japan ..... 7-245002
Jun. 7, 1996 [JP] Japan ..... 8-246262

[51] Int. Cl.[7] ..... B41J 2/05

[52] U.S. Cl. ..... 347/65; 347/40

[58] Field of Search ..... 347/65, 63, 54, 347/40, 43

[56] References Cited

U.S. PATENT DOCUMENTS

| | | | |
|---|---|---|---|
| 4,380,771 | 4/1983 | Takatori | 347/63 X |
| 4,480,259 | 10/1984 | Kruger et al. | 347/63 |
| 4,496,960 | 1/1985 | Fischbeck | 347/68 |
| 4,723,129 | 2/1988 | Endo et al. | 347/56 |
| 4,746,935 | 5/1988 | Allen | 347/15 |
| 4,994,825 | 2/1991 | Saito et al. | 347/63 |
| 5,095,321 | 3/1992 | Saito et al. | 347/63 |
| 5,208,604 | 5/1993 | Watanabe et al. | 347/47 |
| 5,278,585 | 1/1994 | Karz et al. | 347/65 |
| 5,389,957 | 2/1995 | Kimura et al. | 347/20 |
| 5,412,410 | 5/1995 | Rezanka | 347/15 |

FOREIGN PATENT DOCUMENTS

| | | | |
|---|---|---|---|
| 0436047 | 7/1991 | European Pat. Off. | B41J 2/055 |
| 0461935 | 12/1991 | European Pat. Off. | B41J 2/05 |
| 0569156 | 11/1993 | European Pat. Off. | B41J 2/21 |
| 613 781 A1 | 7/1994 | European Pat. Off. | B41J 2/205 |
| 0613781 | 9/1994 | European Pat. Off. | B41J 2/205 |
| 55-81172 | 6/1980 | Japan | B41J 3/04 |
| 61-69467 | 4/1986 | Japan | B41J 3/04 |
| 61-110557 | 5/1986 | Japan | B41J 3/04 |
| 62-156969 | 7/1987 | Japan | B41J 3/04 |
| 63-197652 | 8/1988 | Japan | B41J 3/04 |
| 63-199972 | 8/1988 | Japan | F16K 15/14 |
| 3-81155 | 4/1991 | Japan | B41J 2/05 |
| 4-67954 | 3/1992 | Japan | B41J 2/21 |
| 5-124189 | 5/1993 | Japan | B41J 2/05 |
| 5-169663 | 7/1993 | Japan | B41J 2/05 |
| 6-87214 | 3/1994 | Japan | B41J 2/05 |

OTHER PUBLICATIONS

Examiner's First Report for Australian Patent Appln. No. 65776/96.

*Primary Examiner*—Joseph Hartary
*Attorney, Agent, or Firm*—Fitzpatrick, Cella, Harper & Scinto

[57] ABSTRACT

A liquid ejecting head having at least two liquid ejecting head portions, the liquid ejecting head portions each includes a plurality of ejection outlets for ejecting liquid; a plurality of bubble generating regions for generating bubbles in the liquid; and a plurality of movable members each of which is displaceable between a first position and a second position farther from the bubble generating region than the first position; wherein the movable member is displaced from the first position to the second position by pressure produced by the generation of the bubble in the bubble generating portion to permit expansion of the bubble more in a downstream side closer to the ejection outlet than in an upstream side; an amount of ejection is controlled beforehand by changing at least one of a dimension and a position of the movable member.

49 Claims, 23 Drawing Sheets

FIG. K(a)
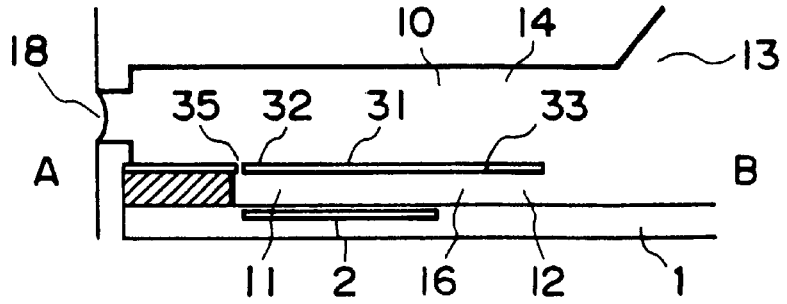
FIG. K(b)
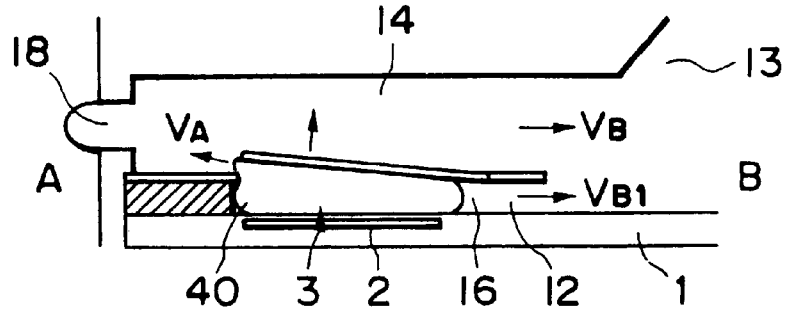
FIG. K(c)
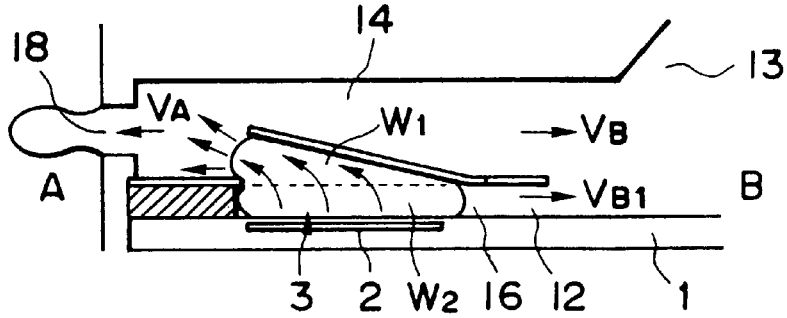
FIG. K(d)
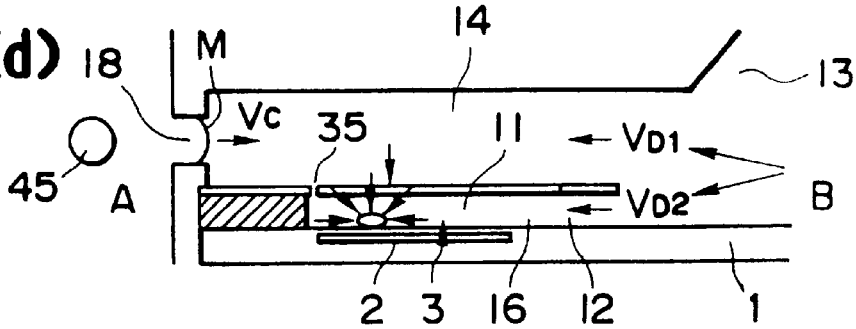

LIQUID EJECTION HEAD AND APPARATUS AND LIQUID EJECTION METHOD

FIELD OF THE INVENTION AND RELATED ART

The present invention relates to a liquid ejecting head, a liquid ejecting apparatus using the liquid ejecting head and a liquid ejecting method, wherein desired liquid is ejected by generation of a bubble created in the liquid by thermal energy.

More particularly, it relates to a liquid ejecting head having a movable member movable by generation of a bubble, and a head cartridge using the liquid ejecting head, and liquid ejecting device using the same. It further relates to a liquid ejecting method and recording method for ejection the liquid by moving the movable member using the generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 and so on discloses a flow passage structure shown in FIGS. 31, (a), (b). The flow passage structure disclosed in or the head manufacturing method this publication has been made noting a backward wave (the pressure wave directed away from the ejection outlet, more particularly, toward a liquid chamber 12) generated in accordance with generation of the bubble.

On the other hand, in the bubble jet recording method, the heating is repeated with the heat generating element contacted with the ink, and therefore, a burnt material is deposited on the surface of the heat generating element due to burnt deposit of the ink. However, the amount of the deposition may be large depending on the materials of the ink. If this occurs, the ink ejection becomes unstable. Additionally, even when the liquid to be ejected is the one easily deteriorated by heat or even when the liquid is the one with which the bubble generated is not sufficient, the liquid is desired to be ejected in good order without property change.

Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to a quite high degree. In addition, the deformation of the flexible film is not so large, and therefore, the energy use efficiency and the ejection force are deteriorated although the some effect is provided by the provision between the ejection liquid and the bubble generation liquid. Recently, bubble jet technique is being used in various field, and is desired to be used with wider range of ejection liquid including middle viscosity liquid or the liquid which is thermally influenced. Also desired is a liquid ejecting head and a device loaded with the head, with which single liquid ejecting head is enough to effect reliable production of multi-level tone gradation printing.

Accordingly, it is a principal object of the present invention to provide liquid ejecting method and liquid ejecting head or the like wherein an ejection energy use efficiency is high with high tone gradation performance.

It is another object of the present invention to provide a liquid ejecting head or the like wherein the ejection efficiency is high, and the ejection is stable with high reliability.

It is a further object of the present invention to provide a liquid ejecting head or the like wherein a liquid ejecting head or head unit capable of effecting tone gradient printing can be manufactured at low cost.

It is a further object of the present invention to provide a liquid ejecting head or the like wherein an inertia, due to a backward wave, in a direction opposite from the liquid supply direction is suppressed, and simultaneously therewith, a meniscus retraction amount is reduced by a valve function of a movable member, so that a refilling frequency is increased, and therefore, the printing speed or the like is improved.

It is a further object of the present invention to provide a liquid ejecting head or the like, wherein accumulated material on a heat generating element is reduced, and an usable range of the ejection liquid is widened, and the ejection efficiency and ejection power are still high.

It is a further object of the present invention to provide a liquid ejecting head or the like with which the selection latitude of the ejection liquid is increased.

It is a further object of the present invention to provide an inexpensive head and device wherein liquid introduction paths for supplying a plurality of liquids are constituted with a small number of parts, and therefore, construction is easy.

It is a further object of the present invention to provide a liquid ejecting method for providing prints of high quality images.

It is a further object of the present invention to provide a head kit for permitting easy reused of the liquid ejecting head.

According to an aspect of the present invention, there is provided a liquid ejecting head having at least two liquid ejecting head portions, the liquid ejecting head portions each comprising: a plurality of ejection outlets for ejecting liquid; a plurality of bubble generating regions for generating bubbles in the liquid; and a plurality of movable members each of which is displaceable between a first position and a second position farther from the bubble generating region than the first position; wherein the movable member is displaced from the first position to the second position by pressure produced by the generation of the bubble in the bubble generating portion to permit expansion of the bubble more in a downstream side closer to the ejection outlet than in an upstream side; an amount of ejection is controlled beforehand by changing at least one of: at least one of a dimension and a position of energy generating means for generating the bubble; at least one of a dimension and a position of the movable member; a dimension of the ejection outlet; at least one of a dimension and a configuration of a structure of a path along which the liquid flows.

According to another aspect of the present invention, there is provided a liquid ejecting head having at least two liquid ejecting head portions, the liquid ejecting head portions each comprising: an ejection outlet for ejecting liquid; a heat generating element for generating a bubble in the liquid by applying heat to the liquid; a supply passage for supplying the liquid onto the heat generating element from an upstream of the heat generating element along the heat generating element; a movable member disposed faced to the heat generating element and having a free end at an ejection outlet side, wherein the free end of the movable member is displaceable, on the basis of a pressure produced by generation of the bubble, to direct the pressure toward the ejection outlet side; an amount of ejection is controlled beforehand by changing at least one of: at least one of a dimension and a position of energy generating means for generating the bubble; at least one of a dimension and a position of the movable member; a dimension of the ejection outlet; at least one of a dimension and a configuration of a structure of a path along which the liquid flows.

According to a further aspect of the present invention, there is provided a liquid ejecting head having at least two liquid ejecting head portions, the liquid ejecting head portions each comprising: an ejection outlet for ejecting liquid; a heat generating element for generating a bubble in the liquid by applying heat to the liquid; a movable member disposed faced to the heat generating element and having a free end at an ejection outlet side, wherein the free end of the movable member is displaceable, on the basis of a pressure produced by generation of the bubble, to direct the pressure toward the ejection outlet side; a supply passage for supplying the liquid onto the heat generating element from an upstream of the movable member along a surface of the movable member closer to the heat generating element; an amount of ejection is controlled beforehand by changing at least one of: at least one of a dimension and a position of energy generating means for generating the bubble; at least one of a dimension and a position of the movable member; a dimension of the ejection outlet; at least one of a dimension and a configuration of a structure of a path along which the liquid flows.

According to a further aspect of the present invention, there is provided a liquid ejecting head having at least two liquid ejecting head portions, the liquid ejecting head portions each comprising: a first liquid flow path in fluid communication with an ejection outlet; a second liquid flow path having bubble generation region for generating the bubble in the liquid by applying heat to the liquid; a movable member disposed between the first liquid flow path and the bubble generation region and having a free end adjacent the ejection outlet, wherein the free end of the movable member is displaced into the first liquid flow path by pressure produced by the generation of the bubble, thus guiding the pressure toward the ejection outlet of the first liquid flow path by the movement of the movable member to eject the liquid; an amount of ejection is controlled beforehand by changing at least one of: at least one of a dimension and a position of energy generating means for generating the bubble; at least one of a dimension and a position of the movable member; a dimension of the ejection outlet; at least one of a dimension and a configuration of a structure of a path along which the liquid flows.

According to a further aspect of the present invention, there is provided a liquid ejecting head having at least two liquid ejecting head portions, the liquid ejecting head portions each comprising: a grooved member integrally having a plurality of ejection outlets for ejecting the liquid, a plurality of grooves for forming a plurality of first liquid flow paths in direct fluid communication with the ejection outlets, and a recess for forming a first common liquid chamber for supplying the liquid to the first liquid flow paths; an element substrate having a plurality of heat generating elements for generating the bubble in the liquid by applying heat to the liquid; and a partition wall disposed between the grooved member and the element substrate and forming a part of walls of second liquid flow paths corresponding to the heat generating elements, and a movable member movable into the first liquid flow paths by pressure produced by the generation of the bubble, the movable member being faced to the heat generating element; an amount of ejection is controlled beforehand by changing at least one of: at least one of a dimension and a position of energy generating means for generating the bubble; at least one of a dimension and a position of the movable member; a dimension of the ejection outlet; at least one of a dimension and a configuration of a structure of a path along which the liquid flows.

According to an aspect of the present invention, the ejection efficiency can be increased.

According to another aspect of the present invention, a liquid ejecting head and a head unit can easily manufactured at low cost with high tone gradation printing performance.

According to further aspect of the present invention, ejection failure of the head can be avoided even after it is kept intact for a long term under low temperature and low humidity conditions, and even if the ejection failure occurred, small scale preliminary ejection or suction recovery is enough to place it back into good order. According to the present invention, the time required for the recovery can be reduced, and the loss of the liquid by the recovery operation is reduced, so that the running cost can be reduced.

According to an aspect of the present invention wherein the refilling property is improved, the responsivity, stabilized growth of the bubble, and the stabilization of the droplet are accomplished under the condition of the continuous ejection, so that the high speed recording and high image quality recording are accomplished by the high speed liquid ejection.

Additionally, by selecting as the bubble generation liquid a liquid with which the deposition such as burnt deposit does not remain on the surface of the heat generating element even upon the heat application or with which the bubble generation is easy, the choice of the ejection liquid is big. For example, a high viscosity liquid with which bubble generation is not easy or a liquid with which the burnt deposit is easy to produced, have been unable to be ejected in a conventional bubble jet ejection method, but they can be ejected according to the present invention.

The bubble generation is stabilized to assure the proper ejections.

The ejection liquid and the bubble generation liquid may be separated, and the ejection liquid is ejected by the pressure produced in the bubble generation liquid.

Furthermore, a liquid which is easy influenced by heat can be ejected without adverse influence.

According to the manufacturing method of the present invention, the liquid ejecting head as has been described hereinbefore can be precisely manufactured with smaller number of parts, at low cost and without difficulty.

By using the liquid ejecting head of the present invention as a liquid ejection recording head, a high image quality recording is accomplished.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1, consisting of FIGS. 1(*a*)–1(*d*) is a schematic sectional view showing an example of a liquid ejecting head according to an embodiment of the present invention.

DESCRIPTION OF THE PREFERRED EMBODIMENTS

Fundamentals

Referring to the accompanying drawings, the fundamentals of ejection of the present invention will be described.

Figure 2:
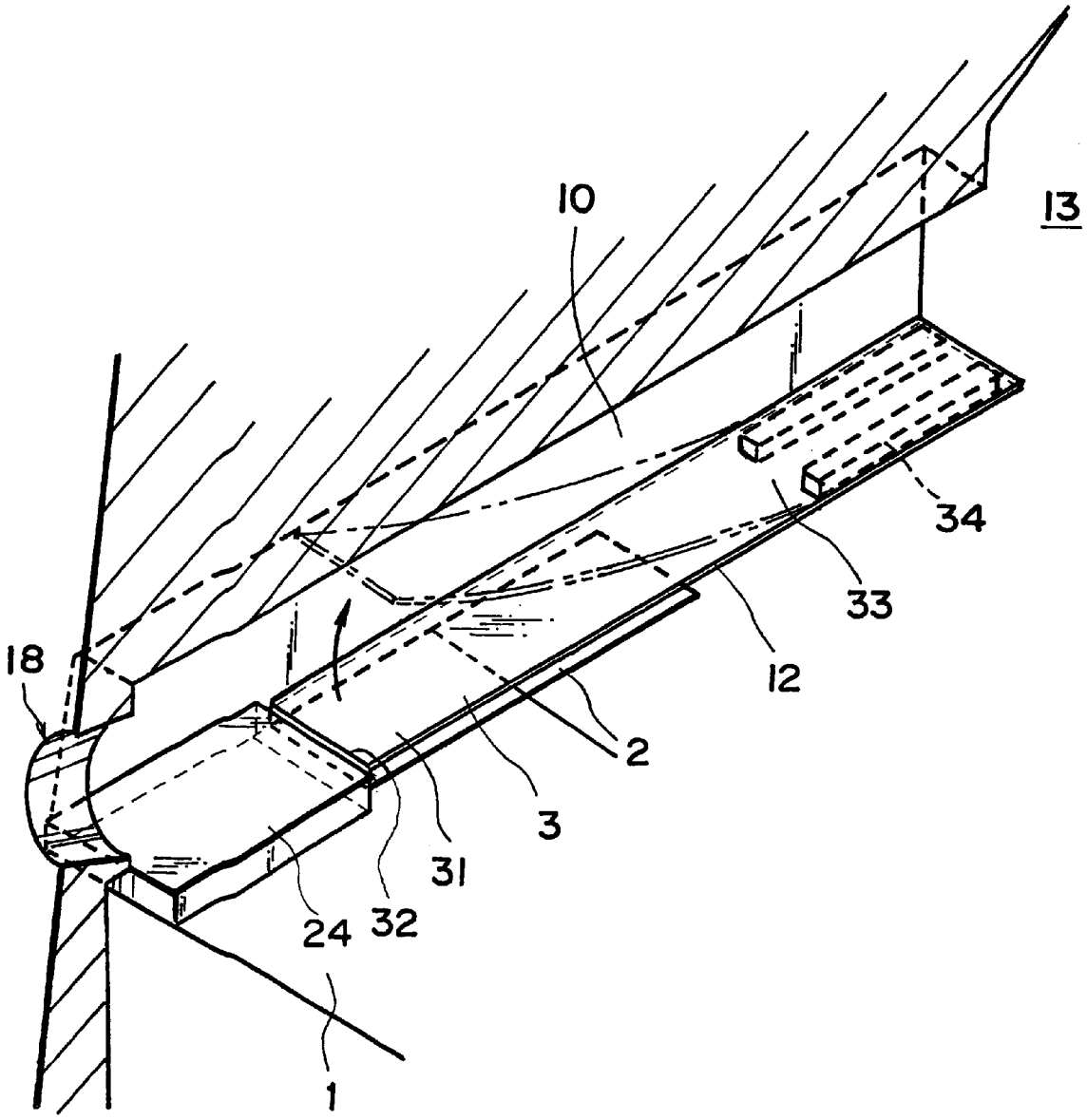
FIG. 2 is a partly broken perspective view of a liquid ejecting head according to an embodiment of the present invention.

FIG. 1 is a schematic sectional view of a liquid ejecting head taken along a liquid flow path according to this embodiment, and FIG. 2 is a partly broken perspective view of the liquid ejecting head.

The liquid ejecting head of this embodiment comprises a heat generating element 2 (a heat generating resistor of 40 μm×105 μm in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18.

Above the element substrate in the liquid flow path 10, a movable member or plate 31 in the form of a cantilever of an elastic material such as metal is provided faced to the heat generating element 2. One end of the movable member is fixed to a foundation (supporting member) 34 or the like provided by patterning of photosensitivity resin material on the wall of the liquid flow path 10 or the element substrate. By this structure, the movable member is supported, and a fulcrum (fulcrum portion) is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and that it has a free end (free end portion) 32 in a downstream side of the fulcrum 33. The movable member 31 is faced to the heat generating element 2 with a gap of 15 μm approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that the movable member 31 moves or displaces to widely open toward the ejection outlet side about the fulcrum 33, as shown in FIGS. 1, (b) and (c) or in FIG. 2. By the displacement of the movable member 31 or the state after the displacement, the propagation of the pressure caused by the generation of the bubble and the growth of the bubble per se are directed toward the ejection outlet.

Here, one of the fundamental ejection principles according to the present invention will be described. One of important principles of this invention is that the movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the ejection outlet 18 (downstream side).

Figure 3:
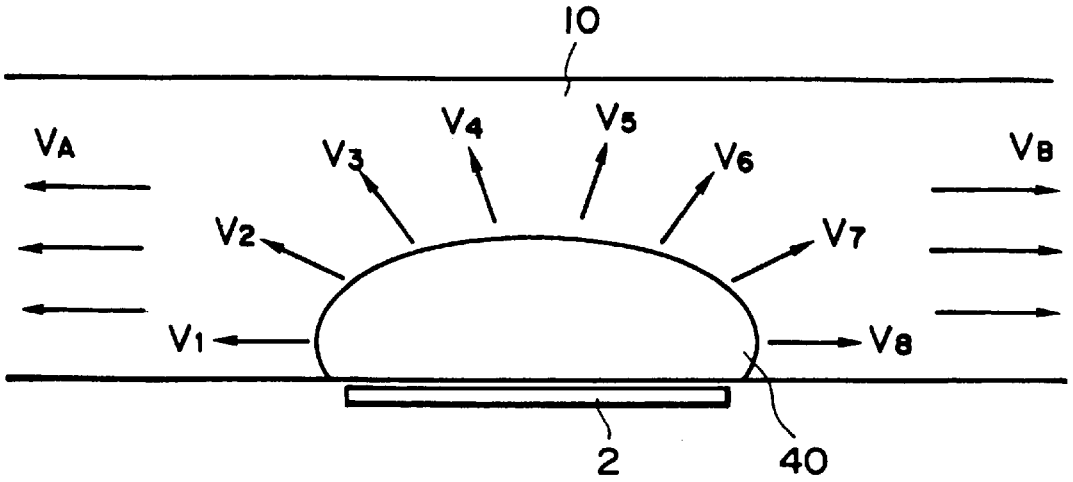
FIG. 3 PRIOR ART
FIG. 3 is a schematic view showing pressure propagation from a bubble in a conventional head.
Figure 4:
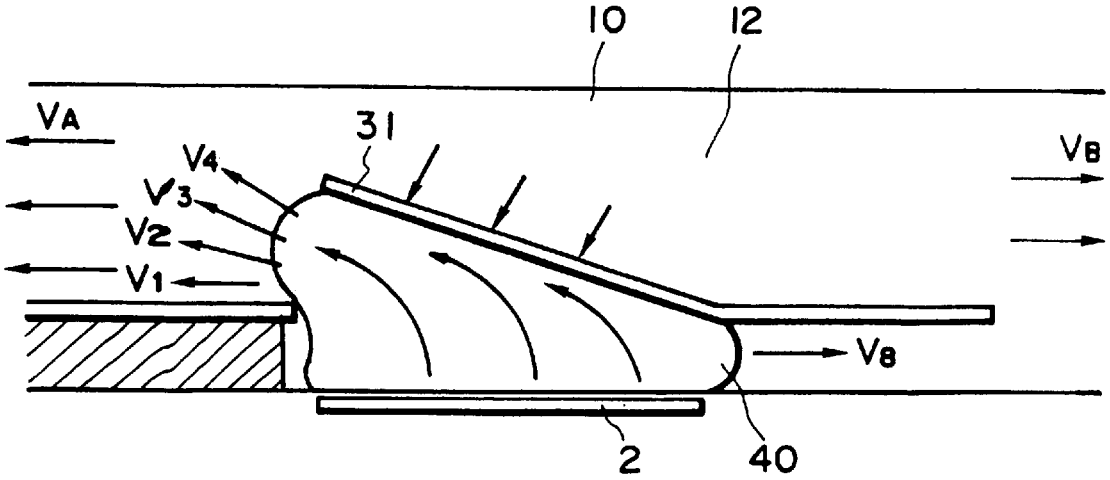
FIG. 4 is a schematic view showing pressure propagation from a bubble in a head according to an embodiment of the present invention.

More detailed description will be made with comparison between the conventional liquid flow passage structure not using the movable member (FIG. 3) and the present invention (FIG. 4). Here, the direction of propagation of the pressure toward the ejection outlet is indicated by $V_A$, and the direction of propagation of the pressure toward the upstream is indicated by $V_B$.

In a conventional head as shown in FIG. 3, there is not any structural element effective to regulate the direction of the propagation of the pressure produced by the bubble 40 generation. Therefore, the direction of the pressure propagation of the is normal to the surface of the bubble as indicated by V1–V8, and therefore, is widely directed in the passage. Among these directions, those of the pressure propagation from the half portion of the bubble closer to the ejection outlet (V1–V4) have the pressure components in the $V_A$ direction which is most effective for the liquid ejection. This portion is important since it directly contributable to the liquid ejection efficiency, the liquid ejection pressure and the ejection speed. Furthermore, the component V1 is closest to the direction of $V_A$ which is the ejection direction, and therefore, is most effective, and the V4 has a relatively small component in the direction $V_A$.

On the other hand, in the case of the present invention, shown in FIG. 4, the movable member 31 is effective to direct, to the downstream (ejection outlet side), the pressure propagation directions V1–V4 of the bubble which otherwise are toward various directions. Thus, the pressure propagations of bubble 40 are concentrated, so that the pressure of the bubble 40 is directly and efficiently contributable to the ejection.

The growth direction per se of the bubble is directed downstream similarly to to the pressure propagation directions V1–V4, and grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIG. 1, the ejecting operation of the liquid ejecting head in this embodiment will be described in detail.

FIG. 1, (a) shows a state before the energy such as electric energy is applied to the heat generating element 2, and therefore, no heat has yet been generated. It should be noted that the movable member 31 is so positioned as to be faced at least to the downstream portion of the bubble generated by the heat generation of the heat generating element. In other words, in order that the downstream portion of the bubble acts on the movable member, the liquid flow passage structure is such that the movable member 31 extends at least to the position downstream (downstream of a line passing through the center 3 of the area of the heat generating element and perpendicular to the length of the flow path) of the center 3 of the area of the heat generating element.

FIG. 1, (b) shows a state wherein the heat generation of heat generating element 2 occurs by the application of the electric energy to the heat generating element 2, and a part of of the liquid filled in the bubble generation region 11 is heated by the thus generated heat so that a bubble is generated through the film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 1, (c) shows a state in which the bubble 40 has further grown. By the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 1, (d) shows the bubble 40 contracting and extinguishing by the decrease of the internal pressure of the bubble after the film boiling.

The movable member 31 having been displaced to the second position returns to the initial position (first position) of FIG. 2, (a) by the restoring force provided by the spring property of the movable member per se and the negative pressure due to the contraction of the bubble. Upon the collapse of bubble, the liquid flows back from the common liquid chamber side as indicated by $V_{D1}$ and $V_{D2}$ and from the ejection outlet side as indicated by $V_c$ so as to compensate for the volume reduction of the bubble in the bubble generation region 11 and to compensate for the volume of the ejected liquid.

In the foregoing, the description has been made as to the operation of the movable member 31 with the generation of the bubble and the ejecting operation of the liquid. Now, the description will be made as to the refilling of the liquid in the liquid ejecting head of the present invention.

Referring to FIG. 1, liquid supply mechanism will be described.

When the bubble 40 enters the bubble collapsing process after the maximum volume thereof (Figure, (c)), a volume of the liquid enough to compensate for the collapsing bubbling volume flows into the bubble generation region from the ejection outlet 18 side of the first liquid flow path 14 and from the common liquid chamber side 13 of the second liquid flow path 16. In the case of conventional liquid flow passage structure not having the movable member 31, the amount of the liquid from the ejection outlet side to the bubble collapse position and the amount of the liquid from the common liquid chamber thereinto, correspond to the flow resistances of the portion closer to the ejection outlet than the bubble generation region and the portion closer to the common liquid chamber (flow path resistances and the inertia of the liquid).

Therefore, when the flow resistance at the supply port side is smaller than the other side, a large amount of the liquid flows into the bubble collapse position from the ejection outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow $V_{D2}$ through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream ($V_{D2}$) of the second liquid flow path along the surface of the heat generating element side of the movable member 31 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that the vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the resulting inertia force. In this embodiment, these actions to the upstream side are suppressed by the movable member 31, so that the refilling performance is further improved.

The description will be made as to a further characterizing feature and the advantageous effect.

The second liquid flow path 16 of this embodiment has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not disappeared are removed without difficulty, and in addition, the heat accumulation in the liquid is not too much. Therefore, the stabilized bubble generation can be repeated at a high speed. In this embodiment, the liquid supply passage 12 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 1. Then, the flow resistance for the liquid between the bubble generation region 11 and the region of the first liquid flow path 14 close to the ejection outlet is increased by the restoration of the movable member to the first position, so that the flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figures 5A, 5B, 5C:
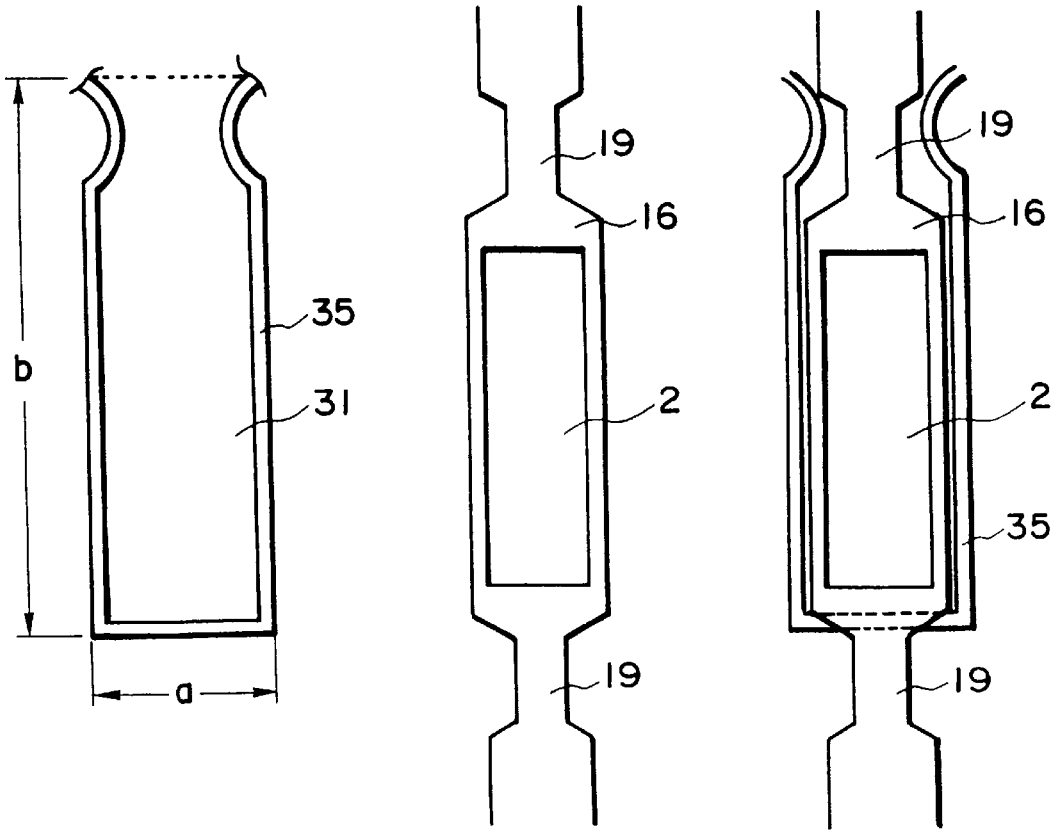
FIG. 5, consisting of FIGS. 5(*a*)–5(*c*), is illustrate a positional relation between the movable member and a second liquid flow path of liquid ejecting head in the present invention, wherein (a) is a top plan view of the movable member, (b) is a top plan view of the second liquid flow path without the separation wall, and (c) is a schematic view wherein the movable member and the second liquid flow path are overlaid.

The positional relation between the free end 32 and the fulcrum 33 of the movable member 31 is such that the free end is at a downstream position of the fulcrum as shown in FIG. 5, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted by the ejection as shown in FIG. 5, returns to the ejection outlet 18 by capillary force or when the liquid supply is effected to compensate for the collapse of bubble, the positions of the free end and the fulcrum 33 are such that the flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

Embodiment 1

The description will be made as to embodiments of the present invention, in conjunction with the accompanying drawings.

This this embodiment uses the ejection fundamentals having been described hereinbefore. The description will be made as to a head wherein a first liquid flow path 14 and second liquid flow path 16 are separated by a separation wall 30 in each embodiment, but the present invention is applicable to any head using the above-described fundamentals.

Figure 6:
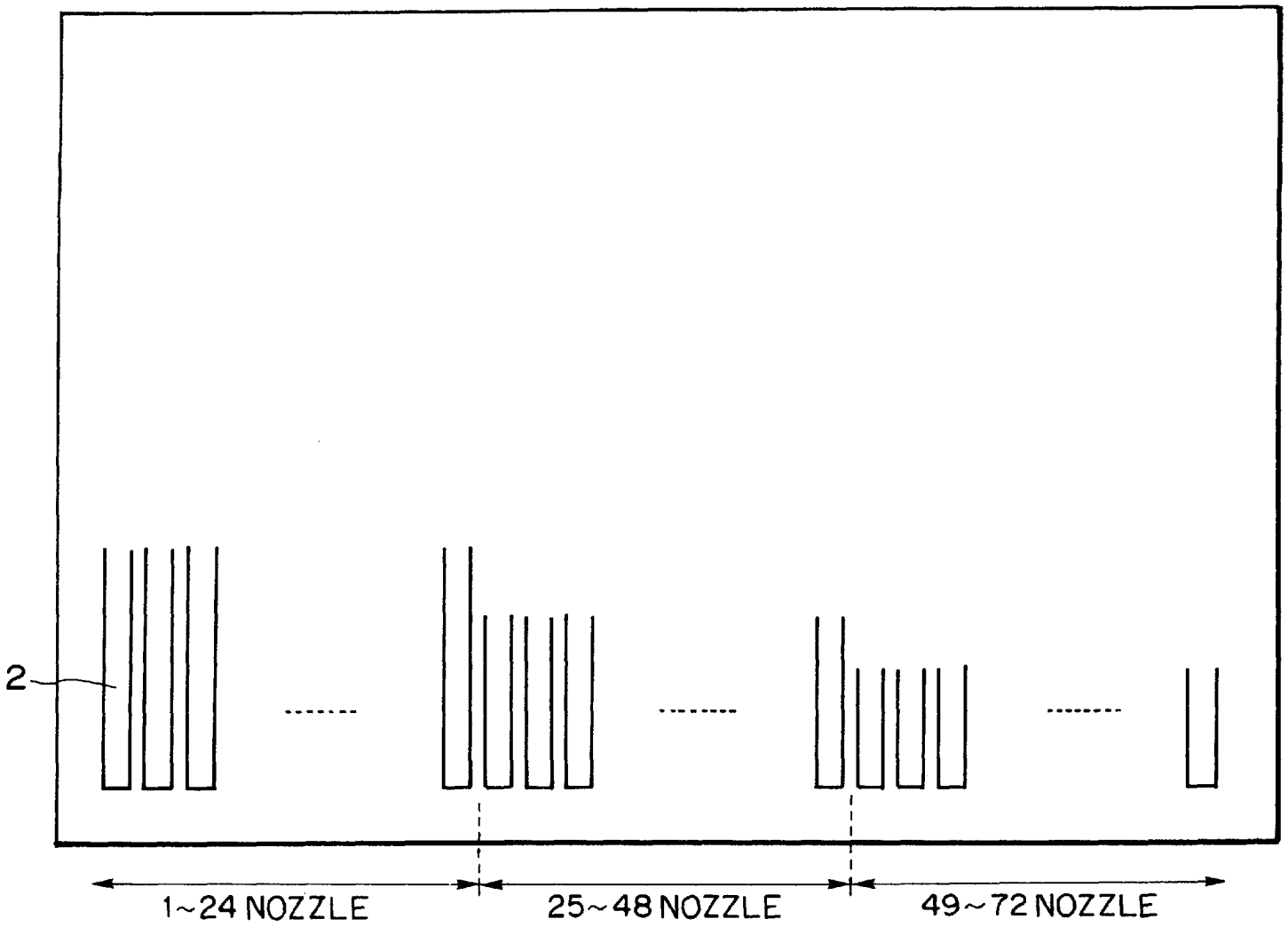
FIG. 6 is a schematic view illustrating arrangements of movable members having different dimensions.

In this embodiment, the liquid ejecting head is provided with 72 nozzles (first to 72nd), and the movable member has a width (a, in FIG. 5) of 40 $\mu$m, a length (b, in FIG. 5) of either 250, 200 or 150 $\mu$m, providing 3 nozzle groups having different ejection amounts, wherein the heat generating element has dimensions of 40×100 $\mu$m, and ejection outlet has a diameter of 800 $\mu$m. FIG. 6 is a schematic top plan view of arrangement of the movable members having different dimensions. Here, the position of the heat generating element relative to the movable member is deviated toward the free end of the movable member.

TABLE 1

| Nozzle No. | Movable member ($\mu$m) | Heater ($\mu$m) | Ejection outlet (dia.) | Ejection amount (pl) |
|---|---|---|---|---|
| 1–24 | 40 × 250 | 40 × 100 | 800 | 80 |
| 25–48 | 40 × 200 | 40 × 100 | 800 | 72 |
| 49–72 | 40 × 150 | 40 × 100 | 800 | 64 |

In each nozzle group, 8 nozzles (first to 8th nozzles, for example) constitute an unit, and even number nozzles (2nd, 4th, 6th and 8th nozzles, for example) and odd number nozzles (1st, 3rd, 5th and 7th nozzles, for example) are separately driven (dispersion driving) in accordance with input image information. As a result, satisfactory prints with tone gradation were produced by a single liquid ejecting head, since the dot diameters of the ink deposited on the recording material are different for individual nozzle groups.

In this embodiment, only the dimensions of the movable members are made different, but the dimensions of movable members may be the same, whereas the diameters of ejection outlets are made different to provide nozzle groups having different ejection amounts. In this case, the provision of the movable members increases the entire ejection efficiency, and therefore, the ejection stability and the reliability are improved.

Embodiment 2

The structure of this embodiment is the same as that of Embodiment 1 with the following exceptions. In this embodiment, the liquid ejecting head is provided with 64 nozzles (first to 64th), and the movable member has a width of 40 μm, a length of either 250 or 150 μm, and the heat generating element has dimensions of either 40×100 μm or 35×100 μm, thus providing 4 different ejection amounts, wherein the ejection outlet has a diameter of 800 μm. Here, the position of the heat generating element relative to the movable member is deviated toward the free end of the movable member.

TABLE 2

| Nozzle No. | Movable member (μm) | Heater (μm) | Ejection outlet (dia.) | Ejection amount (pl) |
|---|---|---|---|---|
| 4, 8, . . . (4x) | 40 × 250 | 40 × 100 | 800 | 80 |
| 1, 5, . . . (4x + 1) | 40 × 250 | 35 × 80 | 800 | 48 |
| 2, 6, . . . (4x + 2) | 40 × 150 | 40 × 100 | 800 | 64 |
| 3, 7, . . . (4x + 3) | 40 × 150 | 35 × 80 | 800 | 39 |

The 64 nozzles are grouped into 8 blocks, wherein 8 nozzles constitute an unit. The even number nozzles and odd number nozzles are separately driven (dispersion driving) in accordance with input image information. As a result, satisfactory prints with tone gradation were produced by a single liquid ejecting head, since the dot diameters of the ink deposited on the recording material are different for individual nozzle groups.

Embodiment 3

The structure of this embodiment is the same as that of Embodiment 1 with the following exceptions. In this embodiment, the liquid ejecting head is provided with 64 nozzles (first to 64th), and the movable member has a width of 40 μm, a length of either 250 or 150 μm, and the heat generating element has dimensions of 40×100 μm, and the ejection outlet has diameters of either 800 μm or 500 μm, thus providing 4 different ejection amounts. The dimensions of the heat generating element is 40×100 μm. Here, the position of the heat generating element relative to the movable member is deviated toward the free end of the movable member.

TABLE 3

| Nozzle No. | Movable member (μm) | Heater (μm) | Ejection outlet (dia.) | Ejection amount (pl) |
|---|---|---|---|---|
| 1–16 | 40 × 250 | 40 × 100 | 800 | 80 |
| 17–32 | 40 × 250 | 40 × 100 | 500 | 32 |
| 33–48 | 40 × 150 | 40 × 100 | 800 | 64 |
| 49–64 | 40 × 150 | 40 × 100 | 500 | 26 |

The 64 nozzles are grouped into 8 blocks, wherein 8 nozzles constitute an unit. The even number nozzles and odd number nozzles are separately driven (dispersion driving) in accordance with input image information. As a result, satisfactory prints with tone gradation were produced by a single liquid ejecting head, since the dot diameters of the ink deposited on the recording material are different for individual nozzle groups.

Embodiment 4

The structure of this embodiment is the same as that of Embodiment 1 with the following exceptions. In this embodiment, the liquid ejecting head is provided with 64 nozzles (first to 64th), and the movable member has a width of 40 μm, a length of either 250 or 150 μm, and the heat generating element has dimensions of either 40×100 μm or 35×100 μm, and the ejection outlet has diameters of either 800 μm or 500 μm, thus providing 8 nozzle groups having different ejection amounts. Here, the position of the heat generating element relative to the movable member is deviated toward the free end of the movable member.

TABLE 4

| Nozzle No. | Movable member (μm) | Heater (μm) | Ejection outlet (dia.) | Ejection amount (pl) |
|---|---|---|---|---|
| 8, 16, . . . (8x) | 40 × 250 | 40 × 100 | 800 | 80 |
| 1, 9, . . . (8x + 1) | 40 × 250 | 40 × 100 | 500 | 32 |
| 2, 10, . . . (8x + 2) | 40 × 250 | 35 × 80 | 800 | 48 |
| 3, 11, . . . (8x + 3) | 40 × 250 | 35 × 80 | 500 | 20 |
| 4, 12, . . . (8x + 4) | 40 × 150 | 40 × 100 | 800 | 64 |
| 5, 13, . . . (8x + 5) | 40 × 150 | 40 × 100 | 500 | 26 |
| 6, 14, . . . (8x + 6) | 40 × 150 | 35 × 80 | 800 | 39 |
| 7, 15, . . . (8x + 7) | 40 × 150 | 35 × 80 | 500 | 16 |

In each nozzle group, 8 nozzles constitute an unit. The even number nozzles and odd number nozzles are separately driven (dispersion driving) in accordance with input image information. As a result, satisfactory prints with tone gradation were produced by a single liquid ejecting head, since the dot diameters of the ink deposited on the recording material are different in 8 ways for individual nozzle groups.

Embodiment 5

Figure 7A:
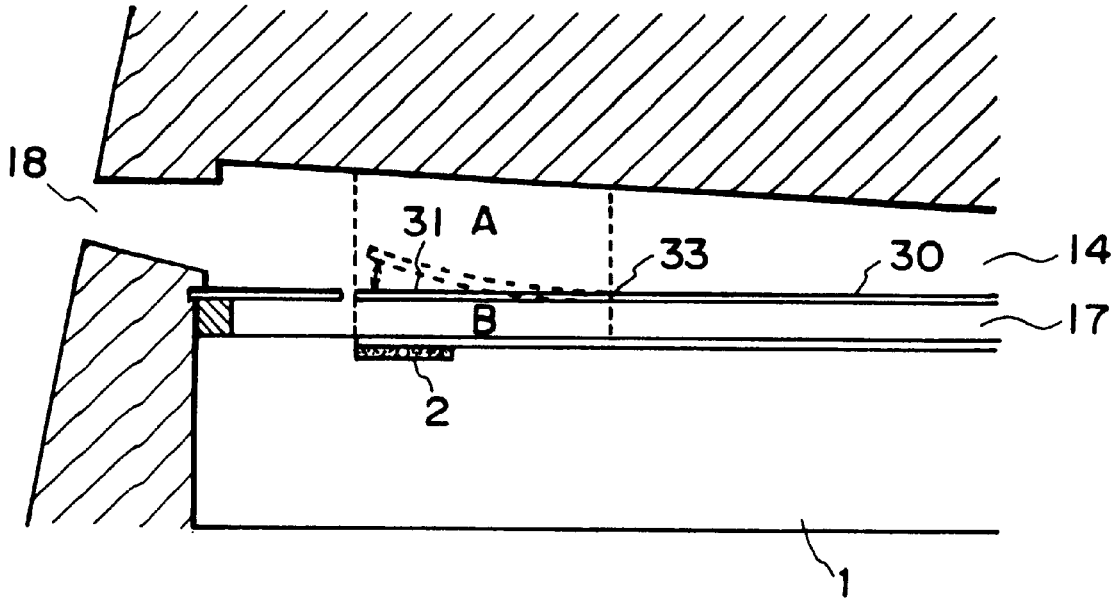
FIG. 7, consisting of FIGS. 7(*a*) and 7(*b*), is a schematic sectional view illustrating a position of a heat generating element relative to a movable member of a liquid ejecting head in the present invention, wherein (a) deals with a case wherein a heat generating element is provided adjacent to a free end side of the movable member, and (b) deals with a case wherein a heat generating element is provided adjacent to a central portion of the movable member.
Figure 7B:
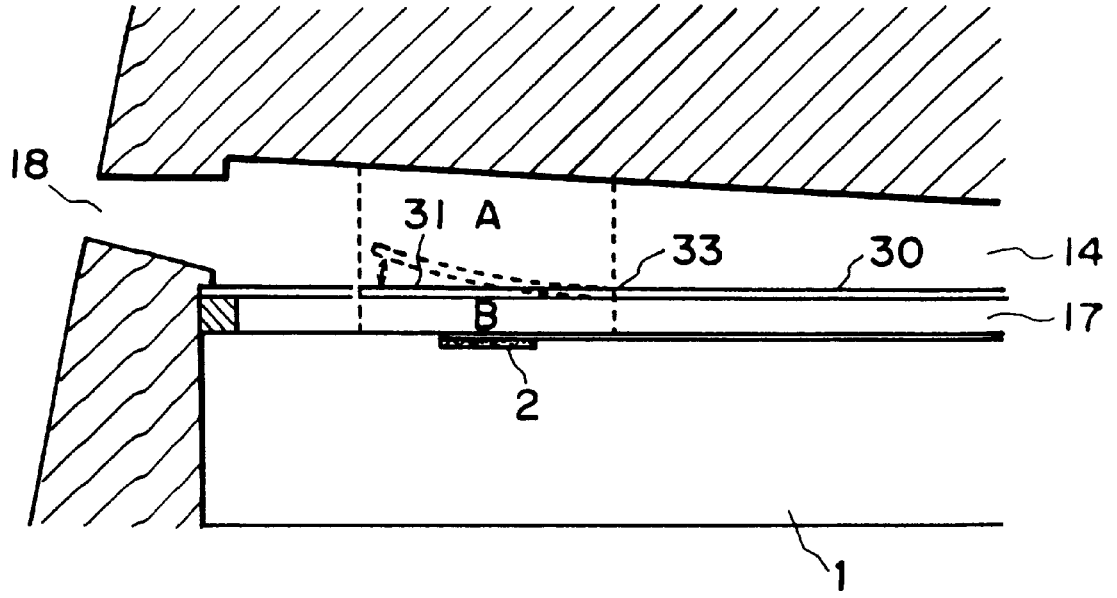

The structure of this embodiment is the same as that of Embodiment 1 with the following exceptions. In this embodiment, the liquid ejecting head is provided with 64 nozzles (first to 64th), and the movable member has a width of 40 μm, a length of either 250 or 150 μm, and the heat generating element has dimensions of 40×100 μm, and the ejection outlet has diameters of 800 μm, and in addition, the relative positions of the heat generating elements to the associated movable members are either one of the relative positions shown in FIG. 6 (free end side, FIG. 7, (a) or center portion side, FIG. 7, (b)) thus providing 4 different ejection amounts.

TABLE 5

| Nozzle No. | Movable member (μm) | Heater (μm) | Ejection outlet (dia.) | Ejection amount (pl) | Heater position relative to heat |
|---|---|---|---|---|---|
| 1–16 | 40 × 250 | 40 × 100 | 800 | 80 | End |
| 17–32 | 40 × 250 | 40 × 100 | 800 | 27 | Center |
| 33–48 | 40 × 150 | 40 × 100 | 800 | 64 | End |
| 49–64 | 40 × 150 | 40 × 100 | 800 | 21 | Center |

The 64 nozzles are grouped into 8 blocks, wherein 8 nozzles constitute an unit. The even number nozzles and odd number nozzles are separately driven (dispersion driving) in accordance with input image information. As a result, satisfactory prints with tone gradation were produced by a single liquid ejecting head, since the dot diameters of the ink deposited on the recording material are different in 8 ways for individual nozzle groups.

Embodiment 6

In Embodiments 1 to 5, the ejection amount is modulated in one liquid ejecting head. In this embodiment, the modulation of ejection amount is effected for each head in a liquid ejecting head unit having a plurality of liquid ejecting heads.

Figure 16:
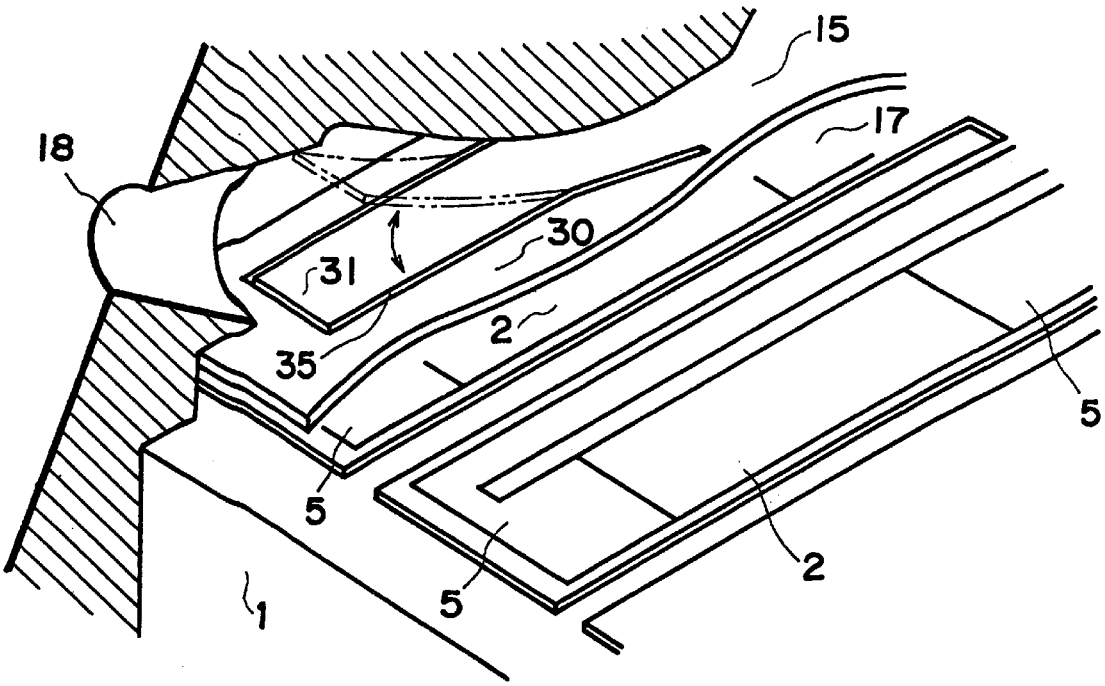
FIG. 16 is a partly broken perspective view of a liquid ejecting head according to a sixth embodiment of the present invention.
Figure 17A:
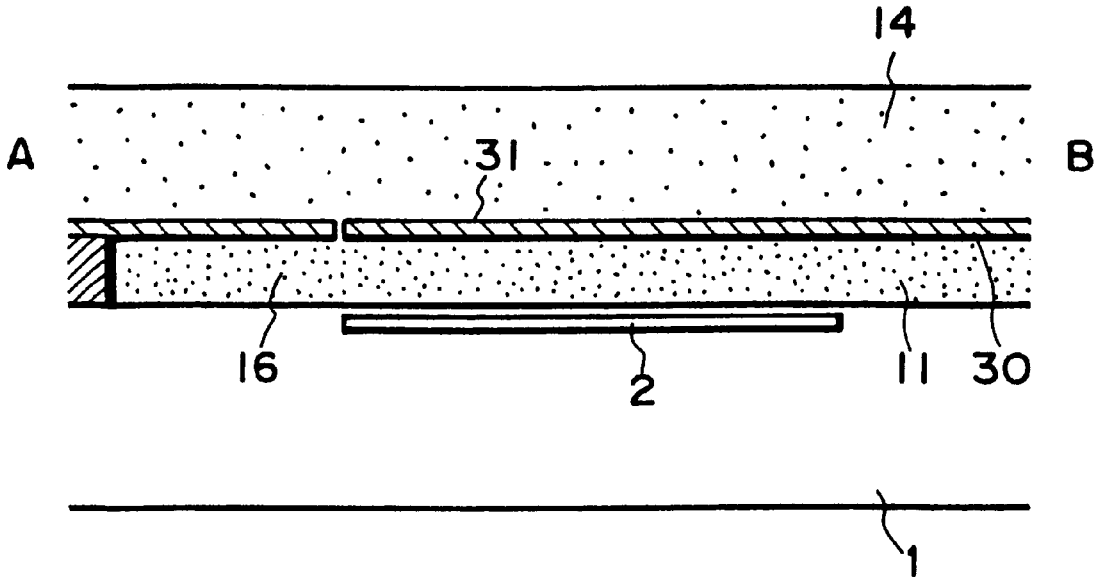
FIG. 17 consisting of FIGS. 17(*a*) and 17(*b*), illustrates an operation of a movable member.
Figure 17B:
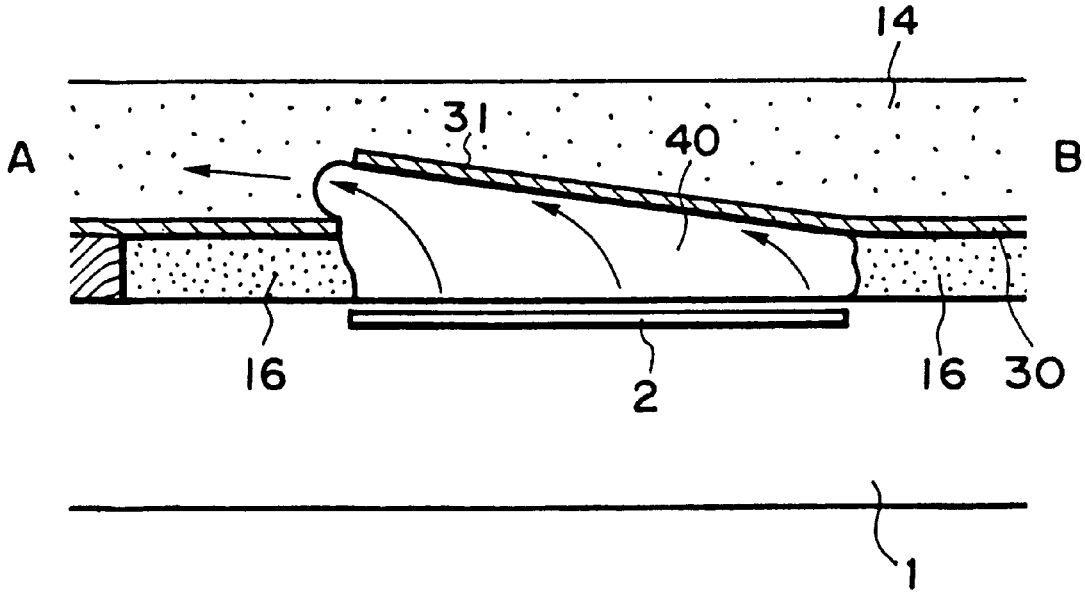

Each liquid ejecting head portion has the structures similar to those of the liquid ejecting head shown in shown in FIG. 16 and FIG. 17, with the following exceptions. The liquid ejecting head unit 800 has two liquid ejecting heads 801 and 802. In this example, the dimensions of the movable members of the separation walls are different for individual liquid ejecting heads (FIG. 8, (b), (c)). Each nozzle of the liquid ejecting head designated by reference numeral 801 has a movable member 31 having a width of 40 μm and a length of 250 μm (FIG. 8, (b)). On the other hand, each nozzle of the liquid ejecting head designated by reference numeral 802 has a movable member 31' having a width of 40 μm and a length of 1 50 μm (FIG. 8, (c)).

Recording was carried out in accordance with input image information, using the liquid ejecting head unit 800 of such a structure, two liquid ejecting heads 801 and 802, and using black (Bk) inks of the same kinds as the ejection liquid. As a result, satisfactory prints with tone gradation, were produced.

In this embodiment, the use was made with a head having a flow path height for the bubble generation liquid which is 15 μm. As an alternative, head units having different ejection amounts can be provided by changing the flow path heights for the bubble generation liquid, while the dimensions of the valves are the same.

It is effective for the ejection amount modulation to change the height and/or the length of the ejection flow paths.

In this case, the provision of the movable members increases the entire ejection efficiency, and therefore, the ejection stability and the reliability are improved.

Embodiment 7

The structure of the liquid ejecting head unit is similar to the foregoing Embodiment 6 except for the following.

The ejection liquid contained in the liquid ejecting head designated by reference numeral 801 is Bk ink having a dye content of 5%. The ejection liquid contained in the liquid ejecting head designated by reference numeral 802 is Bk ink having a dye content of 3%. As a result of image printing provision print, satisfactory prints with tone gradation, were produced.

Embodiment 8

Figure 9:
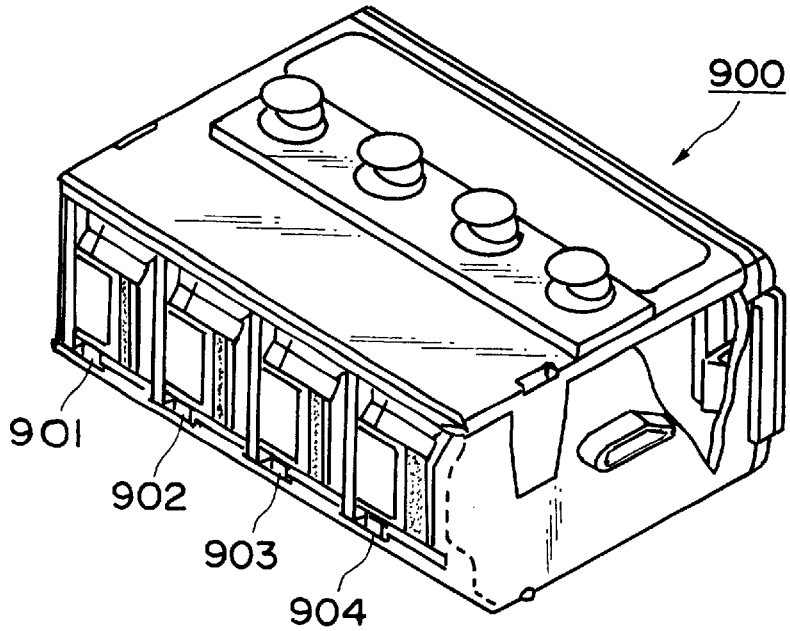
FIG. 9 is a perspective view illustrating a schematic structure of an example of a liquid ejecting head unit according to the present invention.
Figure 10:
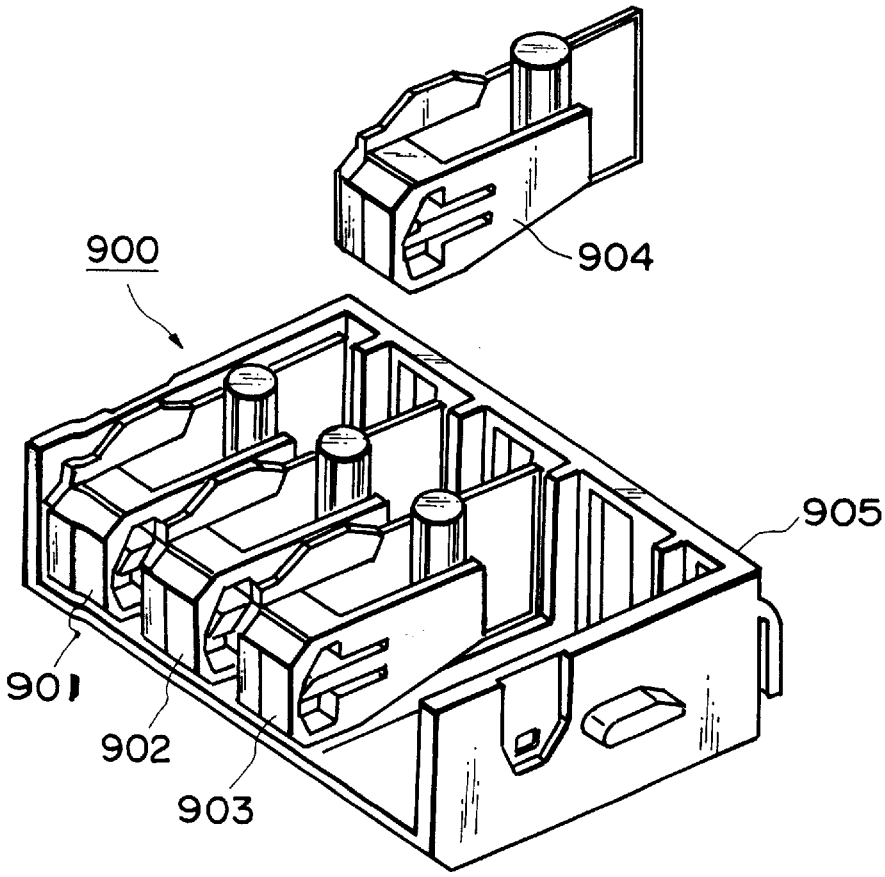
FIG. 10 is a perspective view illustrating a schematic structure of an example of a liquid ejecting head unit according to the present invention.

FIGS. 9 and 10 are perspective views illustrating a schematic structure of a liquid ejecting head unit of an embodiment of the present invention. In this embodiment, the liquid ejecting head unit 900 has four liquid ejecting head 901, 902, 903 and 904 detachably mountable to a holder of the unit. In this example, dimension of the movable members of the separation walls and the diameters of ejection outlets are different for individual liquid ejecting heads.

TABLE 6

| Head | Movable member (μm) | Ejection outlet (dia.) | Ejection liquid |
|---|---|---|---|
| 204 | 40 × 250 | 800 | Bk ink |
| 203 | 40 × 150 | 600 | Y ink |
| 202 | 40 × 150 | 600 | M ink |
| 201 | 40 × 150 | 600 | C ink |

As a result of printing operation in accordance with input image information, satisfactory prints were reliably produced.

Embodiment 9

The structure of the liquid ejecting head unit is similar to the foregoing Embodiment 8 except for the following.

TABLE 7

| Nozzle No. | Movable member (μm) | Heater (μm) | Ejection outlet (dia.) | Ejection liquid |
|---|---|---|---|---|
| 204 | 40 × 250 | 40 × 100 | 800 | Bk ink |
| 203 | 40 × 150 | 35 × 80 | 800 | Y ink |
| 202 | 40 × 150 | 35 × 80 | 800 | M ink |
| 201 | 40 × 150 | 35 × 80 | 800 | C ink |

As a result of printing operation in accordance with input image information, satisfactory prints were reliably produced at low cost.

The structures of said Embodiments 1 to 9 may be modified as follows.

Embodiment 10

Figure 11:
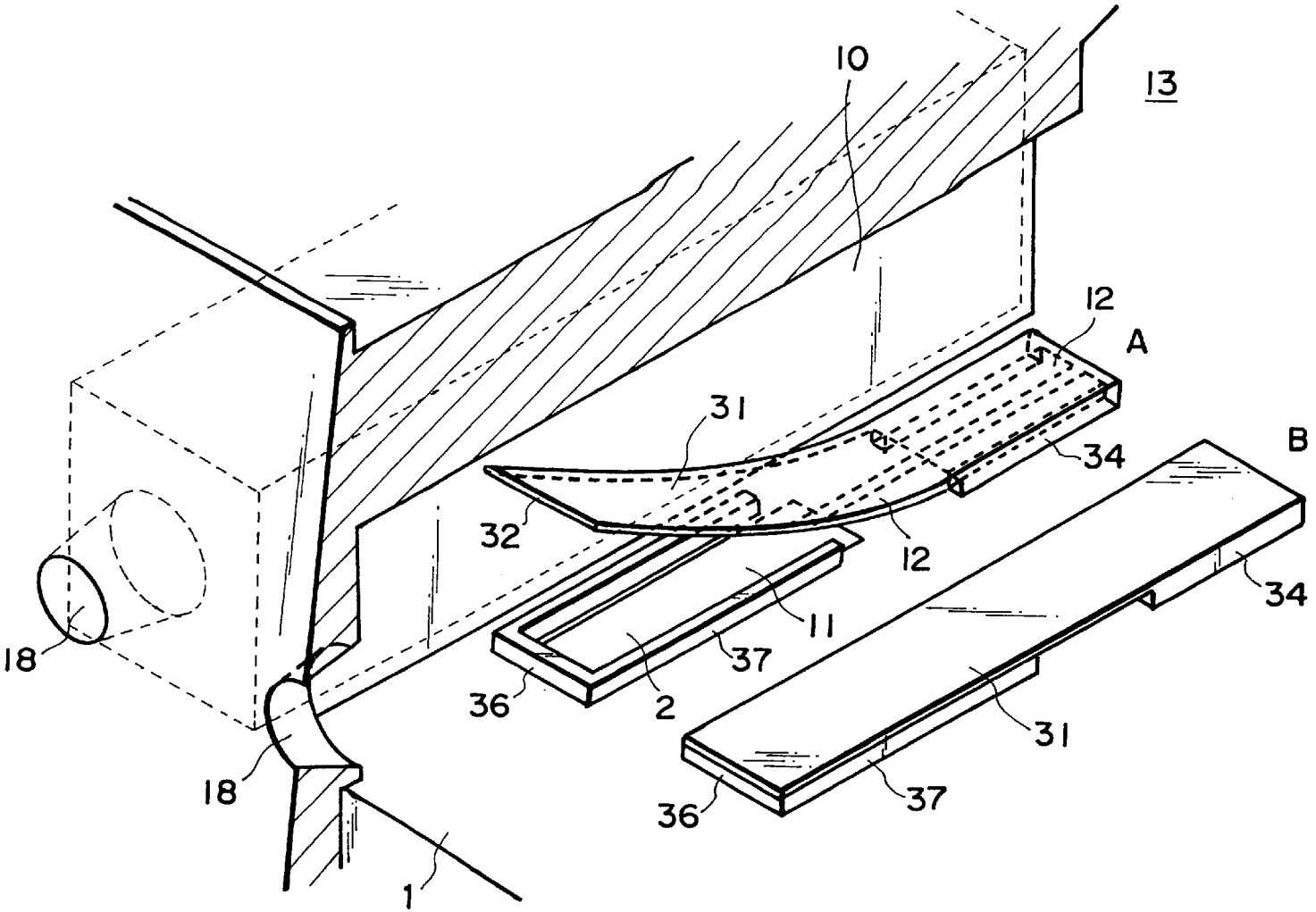
FIG. 11 is a partly broken perspective view of a liquid ejecting head according to a second embodiment of the present invention.

FIG. 11 shows another embodiment of the present invention.

Figure 12:
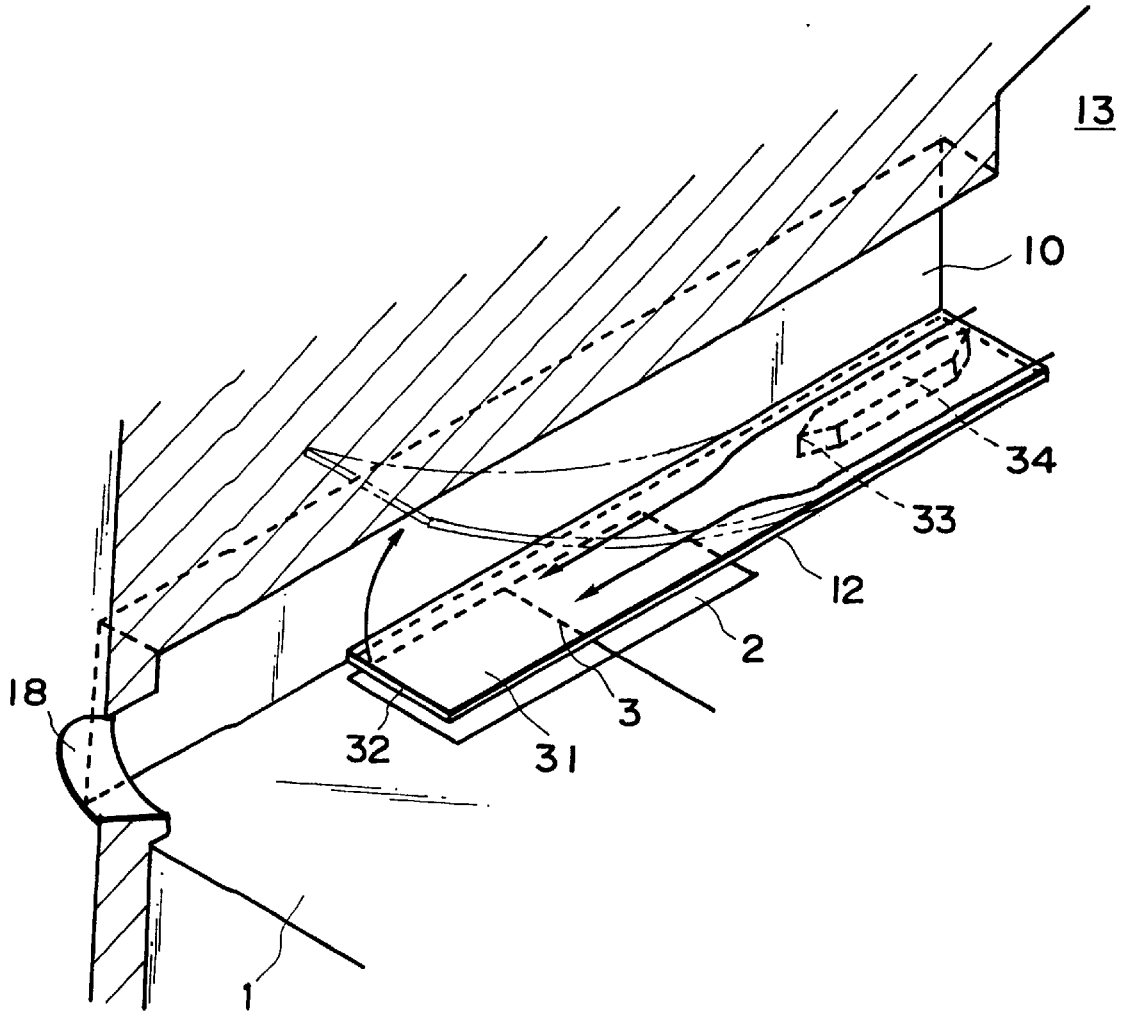
FIG. 12 is a partly broken perspective view of a liquid ejecting head according to a third embodiment of the present invention.

In FIG. 12, A shows a state in which the movable member is displaced (the bubble is not shown), and B shows a state in which the movable member takes the initial or home position (first position), which state is called "substantially hermetically sealed state" for the bubble generation region 11 from the ejection outlet 18. Although not shown, a flow passage wall is provided between A and B to isolate the flow paths.

The movable member 31 in FIG. 11 is set on two lateral foundations 34, and a liquid supply passage 12 is provided therebetween. By this, the liquid is supplied along a heat generating element side surface of the movable member and along a surface substantially flush with or smoothly continuous with the surface of the heat generating element.

When the movable member 31 is at the initial position (first position), the movable member 31 is close to or closely contacted to a downstream wall 36 disposed downstream of the heat generating element 2 and heat generating element side walls 37 disposed at the sides of the heat generating element, so that the ejection outlet 18 side of the bubble generation region 11 is substantially sealed. Thus, the pressure produced by the bubble at the time of the bubble generation and particularly the pressure downstream of the bubble, can be concentrated on the free end side of the movable member, without releasing the pressure.

At the time of the collapse of bubble, the movable member 31 returns to the first position, the ejection outlet side of the bubble generation region 31 is substantially sealed, and therefore, the meniscus retraction is suppressed, and the liquid supply to the heat generating element is carried out with the advantages described hereinbefore. As regards the refilling, the same advantageous effects can be provided as in the foregoing embodiment.

In this embodiment, the foundation 34 for supporting and fixing the movable member 31 is provided at an upstream position away from the heat generating element 2, as shown in FIG. 2 and FIG. 11, and the foundation 34 has a width smaller than the liquid flow path 10 to supply the liquid to the liquid supply passage 12. The configuration of the foundation 34 is not limited to this structure, but may be anyone if smooth refilling is accomplished.

In this embodiment, the clearance between the movable member 31 and the heat generating element 2, was approx. 15 μm, but may be different if the pressure on the basis of the generation of the bubble is sufficiently transmitted to the movable member.

Embodiment 11

FIG. 12 illustrates one of fundamental concept of the present invention. In this embodiment, similarly to Embodiment 1, the liquid ejecting head is provided with 72 nozzles (first to 72nd), and the movable member has a width (a, in FIG. 5) of 40 μm, a length (b, in FIG. 5) of either 250, 200 or 150 μm, providing 3 nozzle groups having different ejection amounts, wherein the heat generating element has dimensions of 40×100 μm, and ejection outlet has a diameter of 800 μm.

FIG. 12 illustrates a positional relation between the movable member, the bubble generating region, in the liquid flow path and the bubble generated there, and also illustrates the liquid ejection method and refilling method according to an embodiment of the present invention.

In the above-described embodiment, the pressure by the generated bubble is concentrated on the free end of the movable member to accomplish the quick movement of the movable member and the concentration of the movement of the bubble to the ejection outlet side. In this embodiment, the bubble is relatively free, while a downstream portion of the bubble which is at the ejection outlet side directly contributable to the droplet ejection, is regulated by the free end side of the movable member.

More particularly, in FIG. 12, the projection (hatched portion) functioning as a barrier provided on the heat generating element substrate 1 of FIG. 2 (embodiment 1) is not provided in this embodiment. The free end region and opposite lateral end regions of the movable member do not substantially seal the bubble generation region relative to the ejection outlet region, but it opens the bubble generation region to the ejection outlet region, in this embodiment.

In this embodiment, the growth of the bubble is permitted at the downstream leading end portion of the downstream portions having direct function for the liquid droplet ejection, and therefore, the pressure component is effectively used for the ejection. Additionally, the upward pressure in this downstream portion (component forces $V_{B2}$, $V_{B3}$ and $V_{B4}$) acts such that the free end side portion of the movable member is added to the growth of the bubble at the leading end portion. Therefore, the ejection efficiency is improved similarly to the foregoing embodiments. As compared with the embodiment, this embodiment is better in the responsivity to the driving of the heat generating element.

Since the structure of this embodiment is simple, the manufacturing thereof is relatively easy.

The fulcrum portion of the movable member 31 of this embodiment is fixed on one foundation 34 having a width smaller than that of the surface of the movable member. Therefore, the liquid supply to the bubble generation region 11 upon the collapse of bubble occurs along both of the lateral sides of the foundation (indicated by an arrow). The foundation may be in another form if the liquid supply performance is assured.

In the case of this embodiment, the existence of the movable member is effective to control the flow into the bubble generation region from the upper part upon the collapse of bubble, the refilling for the supply of the liquid is better than the conventional bubble generating structure having only the heat generating element. The retraction of the meniscus is also decreased thereby.

In a preferable modified embodiment of the third embodiment, both of the lateral sides (or only one lateral side) are substantially sealed for the bubble generation region 11. With such a structure, the pressure toward the lateral side of the movable member is also directed to the ejection outlet side end portion, so that the ejection efficiency is further improved.

Embodiment 12

Figure 13:
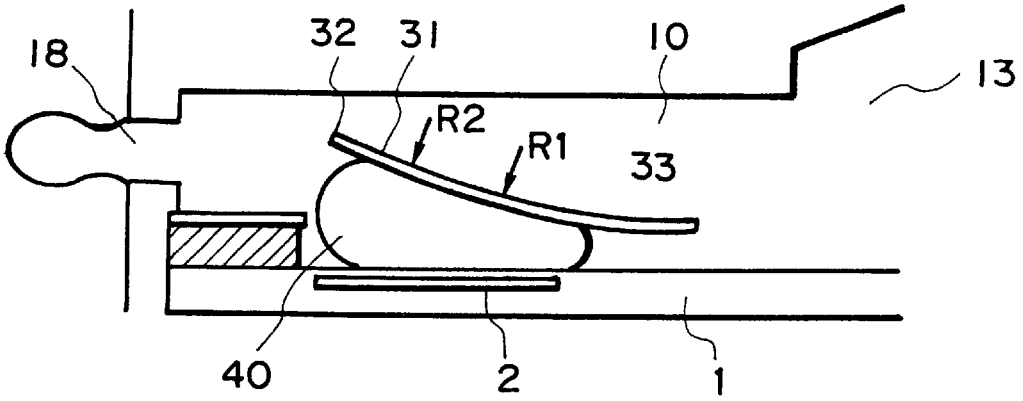
FIG. 13 is a sectional view of a liquid ejecting head (2 flow path) according to a sixth embodiment of the present invention.

In the following embodiment, the ejection force for the liquid by the mechanical displacement is further improved. FIG. 13 is a cross-sectional view of such a head structure. In this embodiment, similarly to Embodiment 1, the liquid ejecting head is provided with 72 nozzles (first to 72nd), and the movable member has a width (a, in FIG. 5) of 40 μm, a length (b, in FIG. 5) of either 250, 200 or 150 μm, providing 3 nozzle groups having different ejection amounts, wherein the heat generating element has dimensions of 40×100 μm, and ejection outlet has a diameter of 800 μm.

In FIG. 13, the movable member is extended such that the position of the free end of the movable member 31 is located further downstream of the heat generating element. By this, the displacing speed of the movable member at the free end position can be increased, and therefore, the production of the ejection power by the displacement of the movable member is further improved.

In addition, the free end is closer to the ejection outlet side than in the foregoing embodiment, and therefore, the growth of the bubble can be concentrated toward the stabilized direction, thus assuring the better ejection.

In response to the growth speed of the bubble at the central portion of the pressure of the bubble, the movable member 31 displaces at a displacing speed R1. The free end 32 which is at a position further than this position from the fulcrum 33, displaces at a higher speed R2. Thus, the free end 32 mechanically acts on the liquid at a higher speed to increase the ejection efficiency.

The free end configuration is such that, as is the same as in FIG. 12, the edge is vertical to the liquid flow, by which the pressure of the bubble and the mechanical function of the movable member are more efficiently contributable to the ejection.

Embodiment 13

Figure 14A:
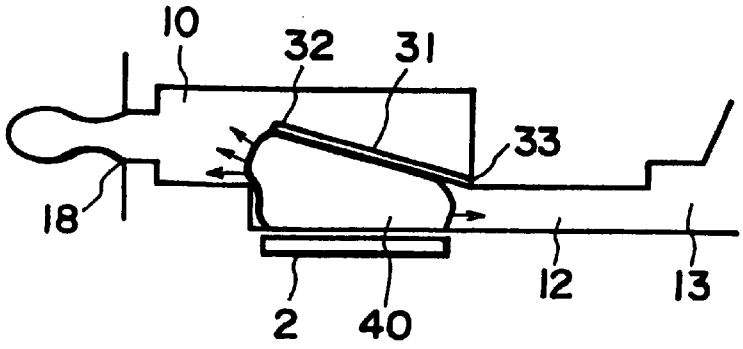
FIG. 14, consisting of FIGS. 14(*a*)–14(*c*) is a schematic sectional view of a liquid ejecting head in a fifth embodiment of the present invention.
Figure 14B:
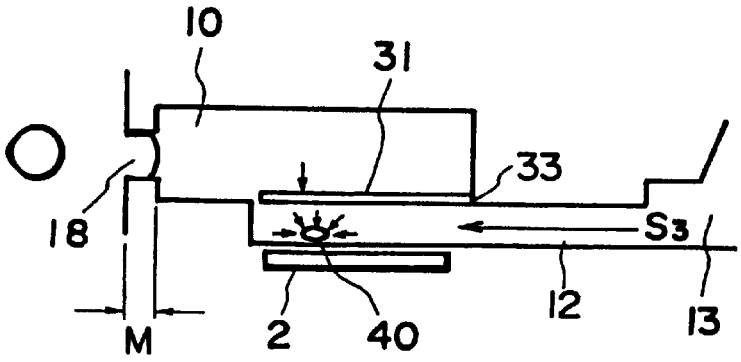
Figure 14C:
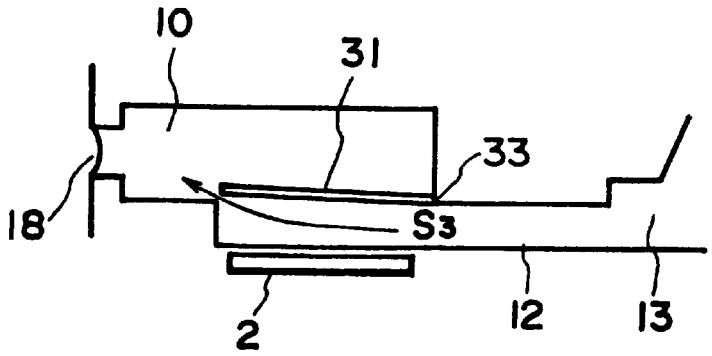

FIGS. 14, (a), (b) and (c) illustrate a fifth embodiment of the present invention. In this embodiment, similarly to Embodiment 1, the liquid ejecting head is provided with 72 nozzles (first to 72nd), and the movable member has a width (a, in FIG. 5) of 40 μm, a length (b, in FIG. 5) of either 250, 200 or 150 μm, providing 3 nozzle groups having different ejection amounts, wherein the heat generating element has dimensions of 40×100 μm, and ejection outlet has a diameter of 800 μm. However, as is different from the foregoing embodiment, the region in direct fluid communication with the ejection outlet is not in fluid communication with the liquid chamber, and therefore, the structure is simplified.

The liquid is supplied only from the liquid supply passage 12 along the surface of the bubble generation region side of the movable member 31. The free end 32 of the movable member 31, the positional relation of the fulcrum 33 relative to the ejection outlet 18 and the structure of facing to the heat generating element 2 are similar to the above-described embodiment.

According to this embodiment, the advantageous effects in the ejection efficiency, the liquid supply performance and so on described above, are accomplished. Particularly, the retraction of the meniscus is suppressed, and a forced refilling is effected substantially thoroughly using the pressure upon the collapse of bubble.

FIG. 14, (a) shows a state in which the bubble generation is caused by the heat generating element 2, and FIG. 10, (b) shows the state in which the bubble is going to contract. At this time, the returning of the movable member 31 to the initial position and the liquid supply by $S_3$ are effected.

In FIG. 14, (c), the small retraction M of the meniscus upon the returning to the initial position of the movable member, is being compensated for by the refilling by the capillary force in the neighborhood of the ejection outlet 18.

Embodiment 14

The description will be made as to a further embodiment.

The ejection principle for the liquid in this embodiment is the same as in the foregoing embodiment. The liquid flow path has a multi-passage structure, and the liquid (bubble generation liquid) for bubble generation by the heat, and the liquid (ejection liquid) mainly ejected, are separated.

Figure 15:
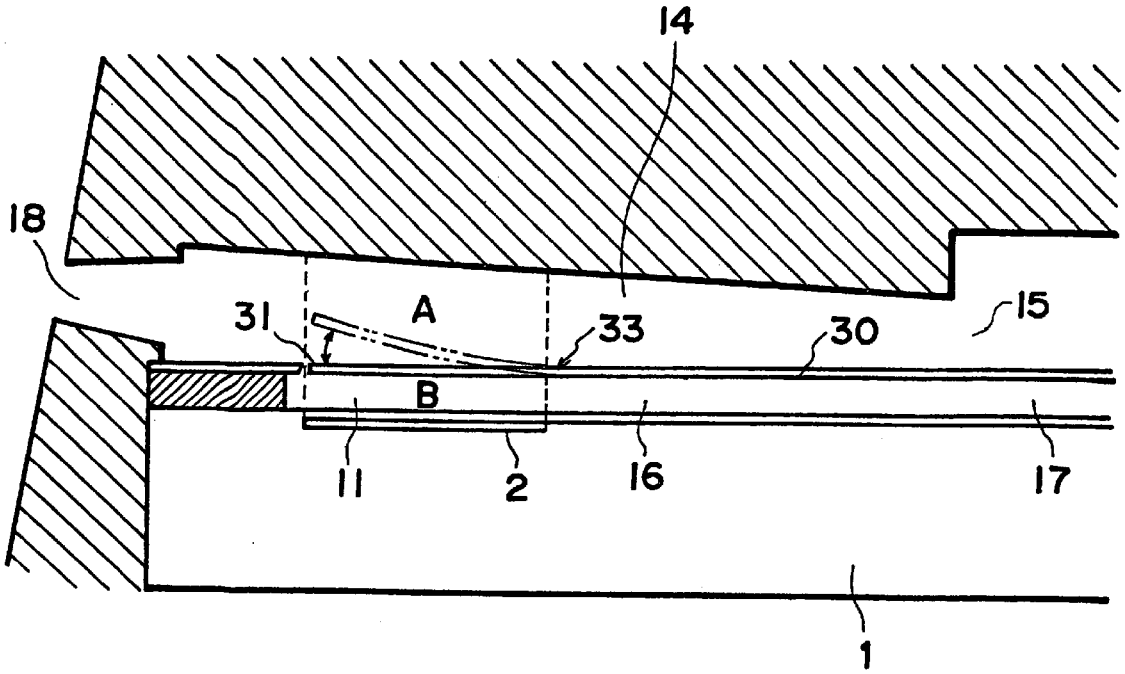
FIG. 15 is a sectional view of a liquid ejecting head (2 flow path) according to a sixth embodiment of the present invention.

FIG. 15 is a sectional schematic view in a direction along the flow path of the liquid ejecting head of this embodiment.

In the liquid ejecting head of this embodiment, a second liquid flow path 16 for the bubble generation is provided on the element substrate 1 which is provided with a heat generating element 2 for supplying thermal energy for generating the bubble in the liquid, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

In the case that the bubble generation liquid and ejection liquid are the same liquids, the number of the common liquid chambers may be one.

Between the first and second liquid flow paths, there is a separation wall 30 of an elastic material such as metal so that the first flow path and the second flow path are separated. In the case that mixing of the bubble generation liquid and the ejection liquid should be minimum, the first liquid flow path 14 and the second liquid flow path 16 are preferably isolated by the partition wall. However, when the mixing to a certain extent is permissible, the complete isolation is not inevitable.

The movable member 31 is in the form of a cantilever wherein such a portion of separation wall as is in an upward projected space of the surface of the heat generating element (ejection pressure generating region, region A and bubble generating region 11 of the region B in FIG. 15) constitutes a free end by the provision of the slit 35 at the ejection outlet side (downstream with respect to the flow of the liquid), and th common liquid chamber (15, 17) side thereof is a fulcrum or fixed portion 33. This movable member 31 is located faced to the bubble generating region 11 (B), and therefore, it functions to open toward the ejection outlet side of the first liquid flow path upon bubble generation of the bubble generation liquid (in the direction indicated by the arrow, in the Figure). In an example of FIG. 16, too, a partition wall 30 is disposed, with a space for constituting a second liquid flow path, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element, are the same as in the previous example.

In the previous example, the description has been made as to the relation between the structures of the liquid supply passage 12 and the heat generating element 2. The relation between the second liquid flow path 16 and the heat generating element 2 is the same in this embodiment.

Referring to FIG. 17, the operation of the liquid ejecting head of this embodiment will be described.

The used ejection liquid in the first liquid flow path 14 and the used bubble generation liquid in the second liquid flow path 16 were the same water base inks.

By the heat generated by the heat generating element 2, the bubble generation liquid in the bubble generation region in the second liquid flow path generates a bubble 40, by film boiling phenomenon as described hereinbefore.

In this embodiment, the bubble generation pressure is not released in the three directions except for the upstream side in the bubble generation region, so that the pressure produced by the bubble generation is propagated concentratedly on the movable member 6 side in the ejection pressure generation portion, by which the movable member 6 is displaced from the position indicated in FIG. 17, (a) toward the first liquid flow path side as indicated in FIG. 17, (b) with the growth of the bubble. By the operation of the movable member, the first liquid flow path 14 and the second liquid flow path 16 are in wide fluid communication with each other, and the pressure produced by the generation of the bubble is mainly propagated toward the ejection outlet in the first liquid flow path (direction A). By the propagation of the pressure and the mechanical displacement of the movable member, the liquid is ejected through the ejection outlet.

Then, with the contraction of the bubble, the movable member 31 returns to the position indicated in FIG. 17, (a), and correspondingly, an amount of the liquid corresponding to the ejection liquid is supplied from the upstream in the first liquid flow path 14. In this embodiment, the direction of the liquid supply is codirectional with the closing of the movable member as in the foregoing embodiments, the refilling of the liquid is not impeded by the movable member.

The major functions and effects as regards the propagation of the bubble generation pressure with the displacement of the movable wall, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. For example, this liquid is supplied into the first liquid flow path, and liquid with which the bubble generation is in good order is supplied into the second path as the bubble generation liquid. An example of the bubble generation liquid a mixture liquid (1–2 cP approx.) of ethanol and water (4:6). By doing so, the ejection liquid can be properly ejected.

Additionally, by selecting as the bubble generation liquid a liquid with which the deposition such as burnt deposit does not remain on the surface of the heat generating element even upon the heat application, the bubble generation is stabilized to assure the proper ejections.

The above-described effects in the foregoing embodiments are also provided in this embodiment, the high viscous liquid or the like can be ejected with a high ejection efficiency and a high ejection pressure.

Furthermore, liquid which is not durable against heat is ejectable. In this case, such a liquid is supplied in the first liquid flow path as the ejection liquid, and a liquid which is not easily altered in the property by the heat and with which the bubble generation is in good order, is supplied in the second liquid flow path. By doing so, the liquid can be ejected without thermal damage and with high ejection efficiency and with high ejection pressure.

Other Embodiments

The description will be made as to additional embodiments. In the following, either a single-flow-path type or two-flow-path type will be taken, but any example is usable for both unless otherwise stated.

Liquid Flow Path Ceiling Configuration

Figure 18:
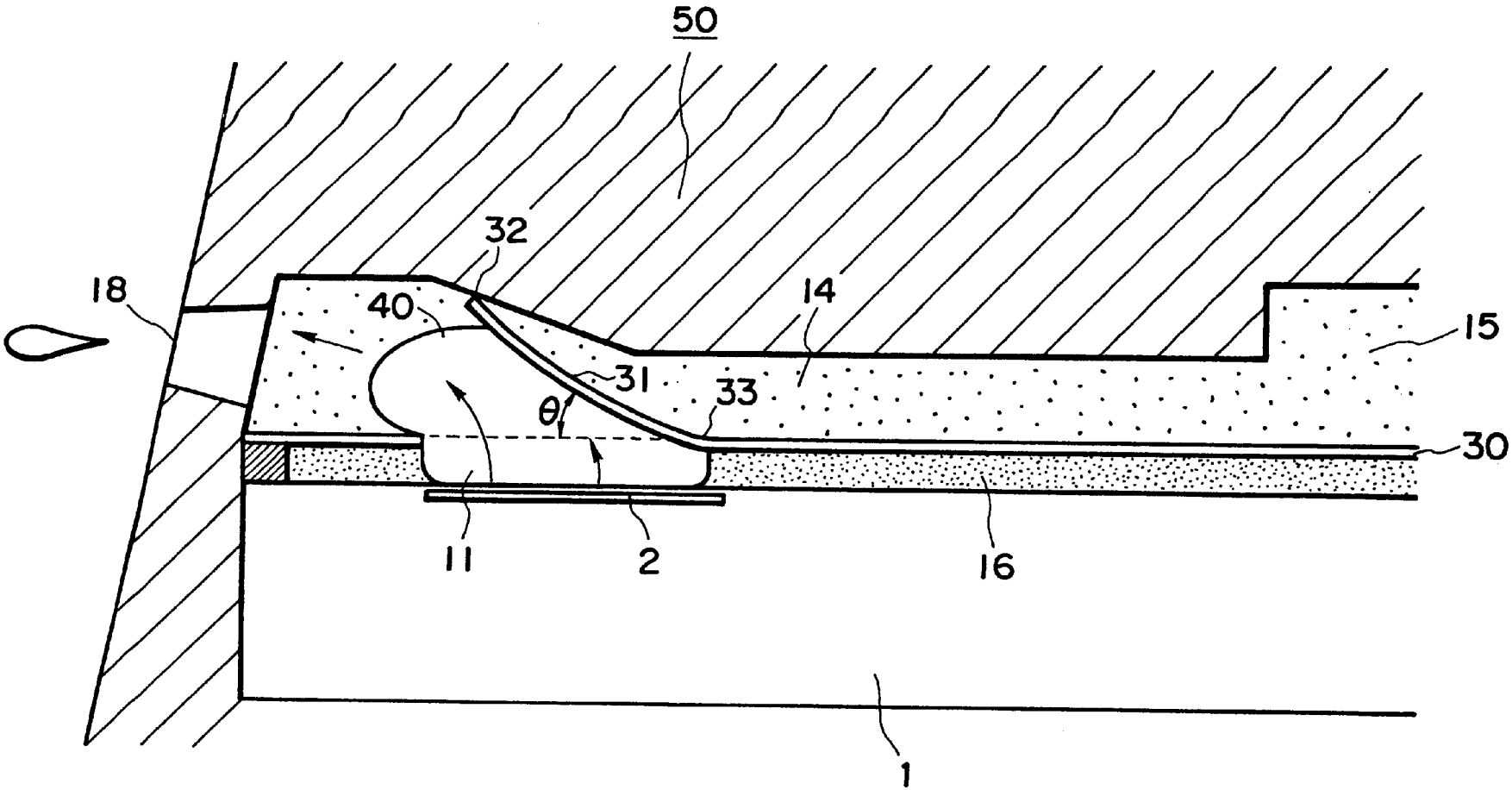
FIG. 18 illustrates a structure of a movable member and a first liquid flow path.

FIG. 18 is a sectional view taken along the length of the flow path of the liquid ejecting head according to the embodiment. Grooves for constituting the first liquid flow paths 14 (or liquid flow paths 10 in FIG. 1) are formed in grooved member 50 on a partition wall 30. In this embodiment, the height of the flow path ceiling adjacent the free end 32 position of the movable member is greater to permit larger operation angle θ of the movable member. The operation range of the movable member is determined in consideration of the structure of the liquid flow path, the durability of the movable member and the bubble generation power or the like. It is desirable that it moves in the angle range wide enough to include the angle of the position of the ejection outlet.

As shown in this Figure, the displaced level of the free end of the movable member is made higher than the diameter of the ejection outlet, by which sufficient ejection pressure is transmitted. As shown in this Figure, a height of the liquid flow path ceiling at the fulcrum 33 position of the movable member is lower than that of the liquid flow path ceiling at the free end 32 position of the movable member, so that the release of the pressure wave to the upstream side due to the displacement of the movable member can be further effectively prevented.

Positional Relation Between Second Liquid Flow Path and Movable Member

Figures 19A, 19B, 19C:
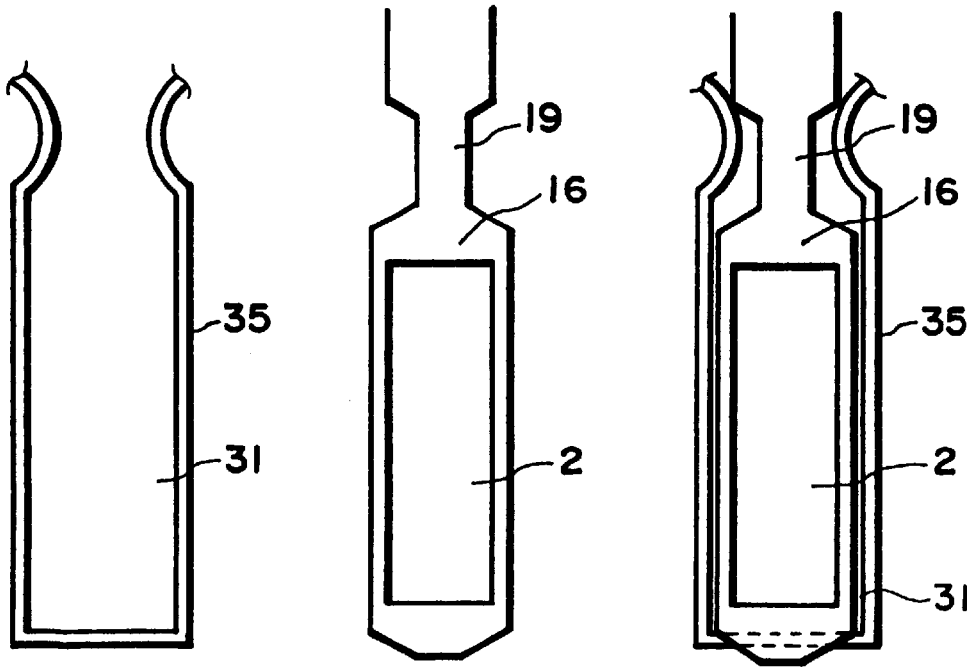
FIG. 19, consisting of FIGS. 19*a*)–19(*c*), is an illustration of a structure of a movable member and a liquid flow path.

FIG. 19 is an illustration of a positional relation between the above-described movable member 31 and second liquid flow path 16, and (a) is a view of the movable member 31 position of the partition wall 30 as seen from the above, and (b) is a view of the second liquid flow path 16 seen from the above without partition wall 30. FIG. 19, (c) is a schematic view of the positional relation between the movable member 6 and the second liquid flow path 16 wherein the elements are overlaid. In these Figures, the bottom is a front side having the ejection outlets.

The second liquid flow path 16 of this embodiment has a throat portion 19 upstream of the heat generating element 2 with respect to a general flow of the liquid from the second common liquid chamber side to the ejection outlet through the heat generating element position, the movable member position along the first flow path, so as to provide a chamber (bubble generation chamber) effective to suppress easy release, toward the upstream side, of the pressure produced upon the bubble generation in the second liquid flow path 16.

In the case of the conventional head wherein the flow path where the bubble generation occurs and the flow path from which the liquid is ejected, are the same, a throat portion may be provided to prevent the release of the pressure generated by the heat generating element toward the liquid chamber. In such a case, the cross-sectional area of the throat portion should not be too small in consideration of the sufficient refilling of the liquid.

However, in the case of this embodiment, much or most of the ejected liquid is from the first liquid flow path, and the bubble generation liquid in the second liquid flow path having the heat generating element is not consumed much, so that the filling amount of the bubble generation liquid to the bubble generation region 11 may be small. Therefore, the clearance at the throat portion 19 can be made very small, for example, as small as several μm—ten and several μm, so that the release of the pressure produced in the second liquid flow path can be further suppressed and to further concentrate it to the movable member side. The pressure can be used as the ejection pressure through the movable member 31, and therefore, the high ejection energy use efficiency and ejection pressure can be accomplished. The configuration of the second liquid flow path 16 is not limited to the one described above, but may be any if the pressure produced by the bubble generation is effectively transmitted to the movable member side.

As shown in FIG. 19, (c), the lateral sides of the movable member 31 cover respective parts of the walls constituting the second liquid flow path so that the falling of the movable member 31 into the second liquid flow path is prevented. By doing so, the above-described separation between the ejection liquid and the bubble generation liquid is further enhanced. Furthermore, the release of the bubble through the slit can be suppressed so that ejection pressure and ejection efficiency are further increased. Moreover, the above-described effect of the refilling from the upstream side by the pressure upon the collapse of bubble, can be further enhanced.

In FIG. 17, (b) and FIG. 18, a part of the bubble generated in the bubble generation region of the second liquid flow path 4 with the displacement of the movable member 6 to the first liquid flow path 14 side, extends into the first liquid flow path 14 side. By selecting the height of the second flow path to permit such extension of the bubble, the ejection force is further improved as compared with the case without such extension of the bubble. To provide such extending of the bubble into the first liquid flow path 14, the height of the second liquid flow path 16 is preferably lower than the height of the maximum bubble, more particularly, the height is preferably several μm—30 μm, for example. In this example, this height is 15 μm.

Movable Member and Partition Wall

FIG. 20 shows another example of the movable member 31, wherein reference numeral 35 designates a slit formed in the partition wall, and the slit is effective to provide the movable member 31. In FIG. 15, (a), the movable member has a rectangular configuration, and in (b), it is narrower in the fulcrum side to permit increased mobility of the movable member, and in (c), it has a wider fulcrum side to enhance the durability of the movable member. The configuration narrowed and arcuated at the fulcrum side is desirable as shown in FIG. 14, (a), since both of easiness of motion and durability are satisfied. However, the configuration of the movable member is not limited to the one described above, but it may be any if it does not enter the second liquid flow path side, and motion is easy with high durability.

In the foregoing embodiments, the plate or film movable member 31 and the separation wall 5 having this movable member was made of a nickel having a thickness of 5 μm, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, polysulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The width of the slit 35 for providing the movable member 31 is 2 μm in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. slit is enough to avoid the liquid mixture, but not more than 3 μm is desirable.

When the ejection liquid and the bubble generation liquid are separated, the movable member functions as a partition therebetween. However, a small amount of the bubble generation liquid is mixed into the ejection liquid. In the case of liquid ejection for printing, the percentage of the mixing is practically of no problem, if the percentage is less than 20%. The percentage of the mixing can be controlled in the present invention by properly selecting the viscosities of the ejection liquid and the bubble generation liquid.

When the percentage is desired to be small, it can be reduced to 5%, for example, by using 5 CPS or lower for the bubble generation liquid and 20 CPS or lower for the ejection liquid.

In this invention, the movable member has a thickness of μm order as preferable thickness, and a movable member having a thickness of cm order is not used in usual cases. When a slit is formed in the movable member having a thickness of μm order, and the slit has the width (W μm) of the order of the thickness of the movable member, it is desirable to consider the variations in the manufacturing.

When the thickness of the member opposed to the free end and/or lateral edge of the movable member formed by a slit, is equivalent to the thickness of the movable member (FIGS. 12, 13 or the like), the relation between the slit width and the thickness is preferably as follows in consideration of the variation in the manufacturing to stably suppress the liquid mixture between the bubble generation liquid and the ejection liquid. When the bubble generation liquid has a viscosity not more than 3 cp, and a high viscous ink (5 cp, 10 cp or the like) is used as the ejection liquid, the mixture of the 2 liquids can be suppressed for a long term if $W/t \leqq 1$ is satisfied.

The slit providing the "substantial sealing", preferably has several microns width, since the liquid mixture prevention is assured.

In the case that the bubble generation liquid and the ejection liquid are used as different function liquids, the movable member functions substantially as a partition or separation member between the liquids. When the movable member moves with the generation of the bubble, a small quantity of the bubble generation liquid may be introduced into the ejection liquid (mixture). Generally, in the ink jet recording, the coloring material content of the ejection liquid is 3% to 5% approx., and therefore, no significant density change results if the percentage of the bubble generation liquid mixed into the ejected droplet is not more than 20%. Therefore, the present invention covers the case where the mixture ratio of the bubble generation liquid of not more than 20%.

In the above-described structure, the mixing ratio of the bubble generation liquid was at most 15% even when the viscosity was changed. When the viscosity of the bubble generation liquid was not more than 5 cP, the mixing ratio was approx. 10% at the maximum, although it was dependent on the driving frequency.

When the viscosity of the ejection liquid is not more than 20 cP, the liquid mixing can be reduced (to not more than 5%, for example).

When the separated bubble generation liquid and ejection liquid are used as has been described hereinbefore, the movable member functions in effect as the separation member. When the movable member moves in accordance with generation of the bubble, a small amount of the bubble generation liquid may be mixed into the ejection liquid. Usually, the ejection liquid for forming an image in the case of the ink jet recording, contains 3% to 5% approx. of the coloring material, and therefore, if content of the leaked bubble generation liquid in the ejection liquid is not more than 20%, no significant density change results. Therefore, the present invention covers the case where the mixture ratio of the bubble generation liquid of not more than 20%.

In the foregoing embodiment, the mixing of the bubble generation liquid is at most 15%, even if the viscosity thereof is changed, and in the case of the bubble generation liquid having the viscosity not more than 5 cP, the mixing ratio was at most 10% approx., although it is different depending on the driving frequency.

The ratio of the mixed liquid can be reduced by reducing the viscosity of the ejection liquid in the range below 20 cps (for example not more than 5%).

The description will be made as to positional relation between the heat generating element and the movable member in this head. The configuration, dimension and number of the movable member and the heat generating element are not limited to the following example. By an optimum arrangement of the heat generating element and the movable member, the pressure upon bubble generation by the heat generating element, can be effectively used as the ejection pressure.

In a conventional bubble jet recording method, energy such as heat is applied to the ink to generate instantaneous volume change (generation of bubble) in the ink, so that the ink is ejected through an ejection outlet onto a recording material to effect printing. In this case, the area of the heat generating element and the ink ejection amount are proportional to each other. However, there is a non-bubble-generation region S not contributable to the ink ejection. This fact is confirmed from observation of kogation on the heat generating element, that is, the non-bubble-generation area S extends in the marginal area of the heat generating element. It is understood that the marginal approx. 4 $\mu$m width is not contributable to the bubble generation.

In order to effectively use the bubble generation pressure, it is preferable that the movable range of the movable member covers the effective bubble generating region of the heat generating element, namely, the inside area beyond the marginal approx. 4 $\mu$m width. In this embodiment, the effective bubble generating region is approx. 4$\mu$ and inside thereof, but this is different if the heat generating element and forming method is different.

FIG. 17 is a schematic view as seen from the top, wherein the use is made with a heat generating element 2 of 58×150 $\mu$m, and with a movable member 301, FIG. 17, (a) and a movable member 302, FIG. 17, (b) which have different total area.

The dimension of the movable member 301 is 53×145 $\mu$m, and is smaller than the area of the heat generating element 2, but it has an area equivalent to the effective bubble generating region of the heat generating element 2, and the movable member 301 is disposed to cover the effective bubble generating region. On the other hand, the dimension of the movable member 302 is 53×220 $\mu$m, and is larger than the area of the heat generating element 2 (the width dimension is the same, but the dimension between the fulcrum and movable leading edge is longer than the length of the heat generating element), similarly to the movable member 301. It is disposed to cover the effective bubble generating region. The tests have been carried out with the two movable members 301 and 302 to check the durability and the ejection efficiency. The conditions were as follows:

Bubble generation liquid: Aqueous solution of ethanol (40%).

Ejection ink: dye ink

Voltage: 20.2 V

Frequency: 3 kHz

The results of the experiments show that the movable member 301 was damaged at the fulcrum when $1\times10^7$ pulses were applied. The movable member 302 was not damaged even after $3\times10^8$ pulses were applied. Additionally, the ejection amount relative to the supplied energy and the kinetic energy determined by the ejection speed, are improved by approx. 1.5–2.5 times.

From the results, it is understood that a movable member having an area larger than that of the heat generating element and disposed to cover the portion right above the effective bubble generating region of the heat generating element, is preferable from the standpoint of durability and ejection efficiency.

Figure 23:
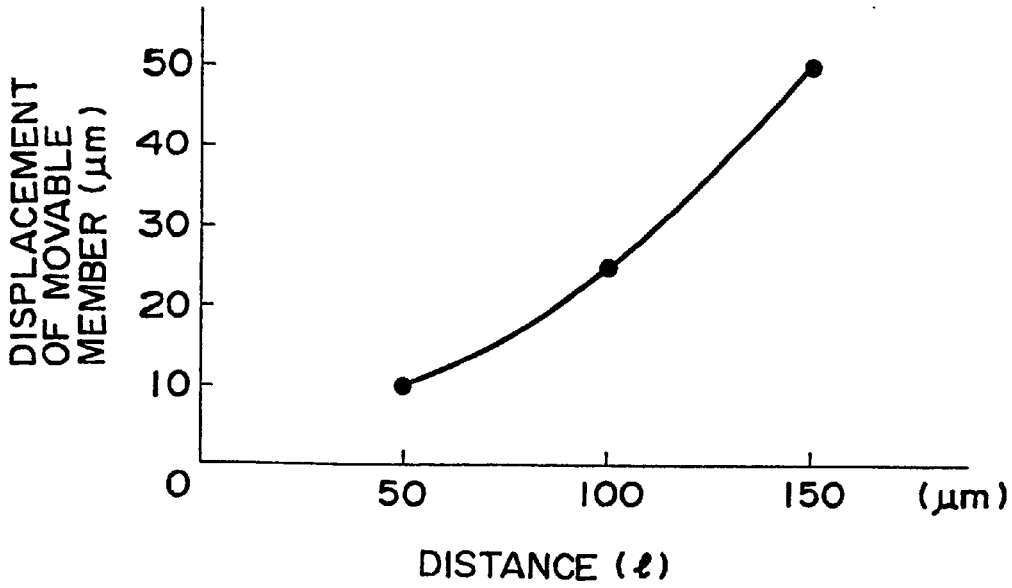
FIG. 23 shows a relation between a distance from an edge of a heat generating element to a fulcrum and a displacement of the movable member.
Figure 24:
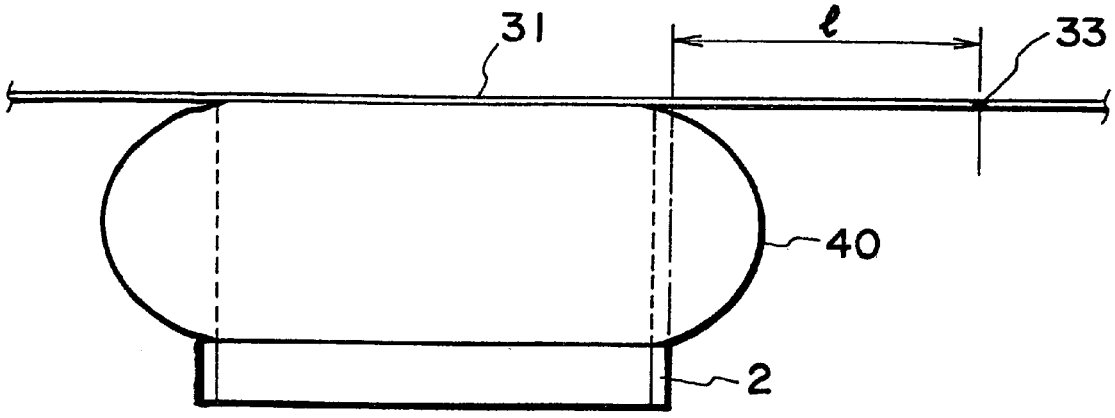
FIG. 24 illustrates a positional relation between a heat generating element and a movable member.

FIG. 23 shows a relation between a distance between the edge of the heat generating element and the fulcrum of the movable member and the displacement of the movable member. FIG. 19 is a section view, as seen from the side, which shows a positional relation between the heat generating element 2 and the movable member 31. The heat generating element 2 has a dimension of 40×105 $\mu$m. It will be understood that the displacement increases with increase with the distance 1 from the edge of the heat generating element 2 and the fulcrum 33 of the movable member 31. Therefore, it is desirable to determinate the position of the fulcrum of the movable member on the basis of the optimum displacement depending on the required ejection amount of the ink, flow passage structure, heat generating element configuration and so on.

When the fulcrum of the movable member is right above the effective bubble generating region of the heat generating element, the bubble generation pressure is directly applied to the fulcrum in addition to the stress due to the displacement of the movable member, and therefore, the durability of the movable member lowers. The experiments by the inventors have revealed that when the fulcrum is provided right above the effective bubble generating region, the movable wall is damaged after application of $1\times10^6$ pulses, that is, the durability is lower. Therefore, by disposing the fulcrum of the movable member outside the right above position of the effective bubble generating region of the heat generating element, a movable member of a configuration and/or a material not providing very high durability, can be practically usable. On the other hand, even if the fulcrum is right above the effective bubble generating region, it is practically usable if the configuration and/or the material is properly selected. By doing so, a liquid ejecting head with the high ejection energy use efficiency and the high durability can be provided.

Element Substrate

The description will be made as to a structure of the element substrate provided with the heat generating element for heating the liquid.

Figure 25A:
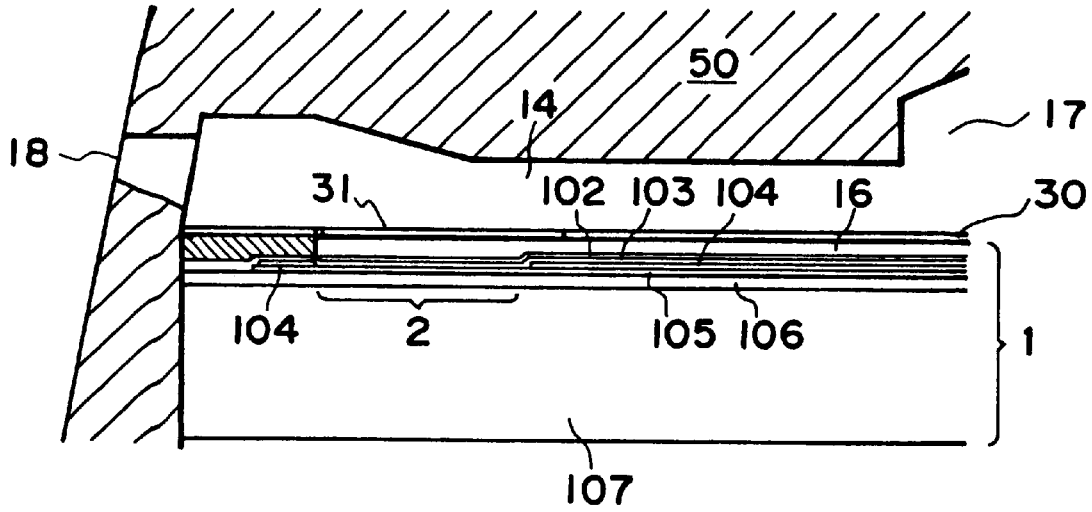
FIG. 25, consisting of FIGS. 25(*a*) and 25(*b*), is a longitudinal sectional view of a liquid ejecting head of the present invention.
Figure 25B:
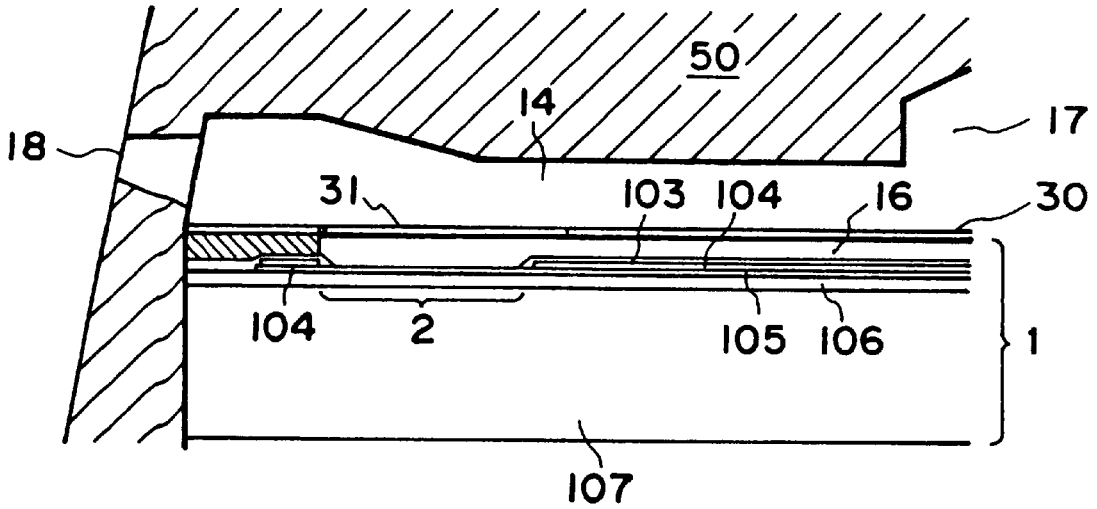

FIG. 25 is a longitudinal section of the liquid ejecting head according to an embodiment of the present invention.

On the element substrate 1, a grooved member 50 is mounted, the member 50 having second liquid flow paths 16, separation walls 30, first liquid flow paths 14 and grooves for constituting the first liquid flow path.

The element substrate 1 has, as shown in FIG. 11, patterned wiring electrode (0.2–1.0 $\mu$m thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink.

The pressure and shock wave generated upon the bubble generation and collapse is so strong that the durability of the oxide film which is relatively fragile is deteriorated. Therefore, metal material such as tantalum (Ta) or the like is used as the anti-cavitation layer.

The protection layer may be omitted depending on the combination of liquid, liquid flow path structure and resistance material. One of such examples is shown in FIG. 25 (*b*). The material of the resistance layer not requiring the protection layer, includes, for example, iridium-tantalum-aluminum alloy or the like. Thus, the structure of the heat generating element in the foregoing embodiments may include only the resistance layer (heat generation portion) or may include a protection layer for protecting the resistance layer.

In the embodiment, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selective driving the electrothermal transducer element may also be integrally built in, in addition to the resistance layer 105 constituting the heat generation portion and the electrothermal transducer constituted by the wiring electrode 104 for supplying the electric signal to the resistance layer.

Figure 21:
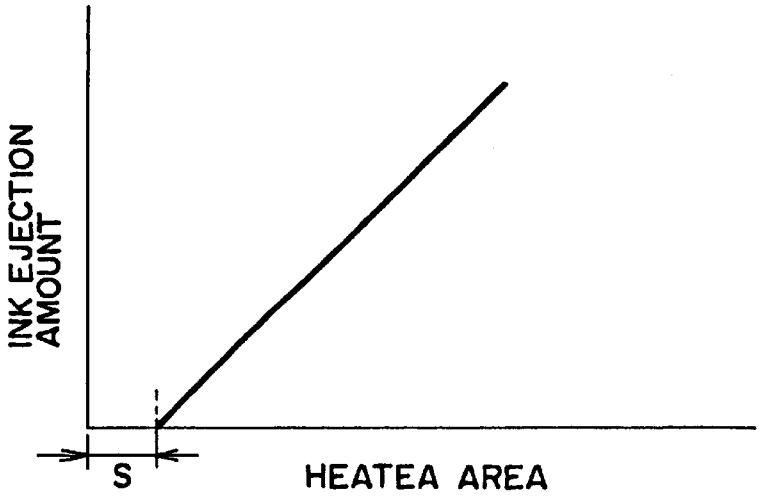
FIG. 21 shows a relation between an area of a heat generating element and an ink ejection amount.
Figure 22A:
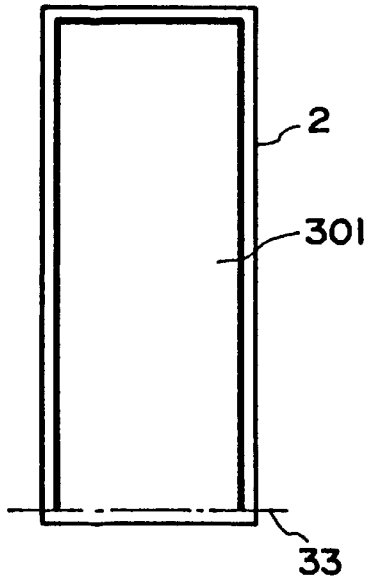
FIG. 22, consisting of FIGS. 22(*a*) and 22(*b*), shows a positional relation between a movable member and a heat generating element.
Figure 22B:
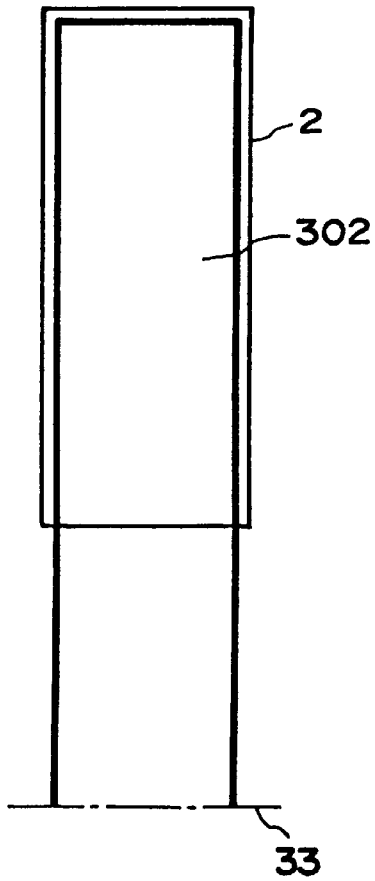

In order to eject the liquid by driving the heat generation portion of the electrothermal transducer on the above-described element substrate 1, the resistance layer 105 is supplied through the wiring electrode 104 with rectangular pulses as shown in FIG. 21 to cause instantaneous heat generation in the resistance layer 105 between the wiring electrode. In the case of the heads of the foregoing embodiments, the applied energy has a voltage of 24 V, a pulse width of 7 μsec, a current of 150 mA and a frequency of 6 kHz to drive the heat generating element, by which the liquid ink is ejected through the ejection outlet through the process described hereinbefore. However, the driving signal conditions are not limited to this, but may be any if the bubble generation liquid is properly capable of bubble generation.

Head Structure of 2 Flow Path Structure

The description will be made as to a structure of the liquid ejecting head with which different liquids are separately accommodated in first and second common liquid chamber, and the number of parts can be reduces so that the manufacturing cost can be reduced.

Figure 27:
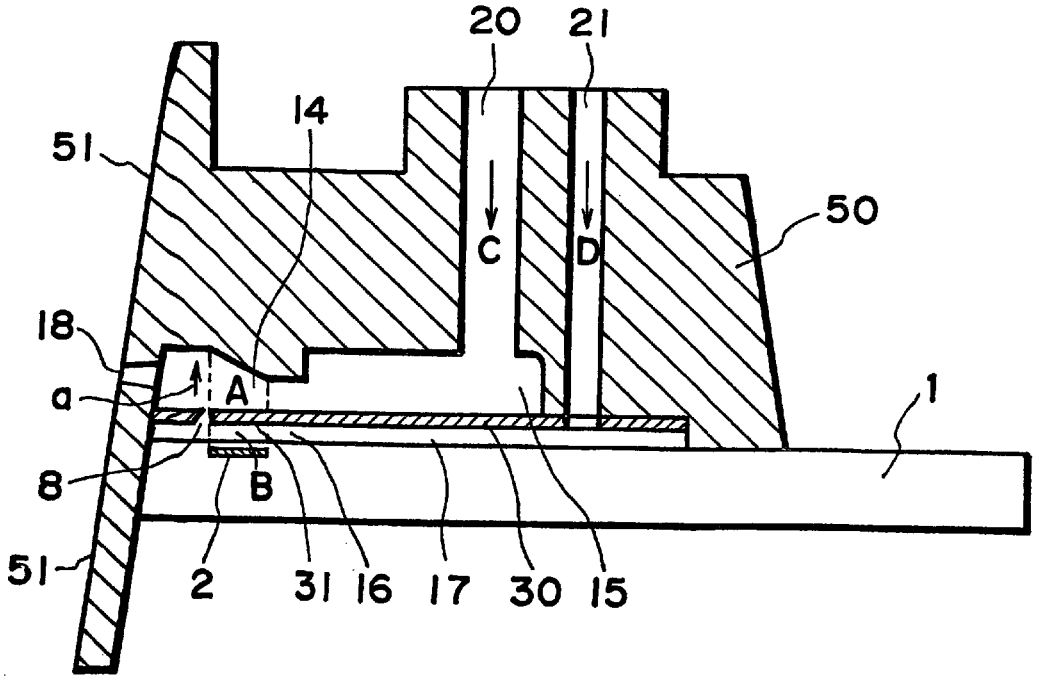
FIG. 27 is a sectional view illustrating a supply passage of a liquid ejecting head of the present invention.

FIG. 27 is a schematic view of such a liquid ejecting head. The same reference numerals as in the previous embodiment are assigned to the elements having the corresponding functions, and detailed descriptions thereof are omitted for simplicity.

In this embodiment, a grooved member 50 has an orifice plate 51 having an ejection outlet 18, a plurality of grooves for constituting a plurality of first liquid flow paths 14 and a recess for constituting the first common liquid chamber 15 for supplying the liquid (ejection liquid) to the plurality of liquid flow paths 14. A separation wall 30 is mounted to the bottom of the grooved member 50 by which plurality of first liquid flow paths 14 are formed. Such a grooved member 50 has a first liquid supply passage 20 extending from an upper position to the first common liquid chamber 15. The grooved member 50 also has a second liquid supply passage 21 extending from an upper position to the second common liquid chamber 17 through the separation wall 30.

As indicated by an arrow C in FIG. 27, the first liquid (ejection liquid) is supplied through the first liquid supply passage 20 and first common liquid chamber 15 to the first liquid flow path 14, and the second liquid (bubble generation liquid) is supplied to the second liquid flow path 16 through the second liquid supply passage 21 and the second common liquid chamber 17 as indicated by arrow D in FIG. 27.

In this example, the second liquid supply passage 21 is extended in parallel with the first liquid supply passage 20, but this is not limited to the exemplification, but it may be any if the liquid is supplied to the second common liquid chamber 17 through the separation wall 30 outside the first common liquid chamber 15.

The (diameter) of the second liquid supply passage 21 is determined in consideration of the supply amount of the second liquid. The configuration of the second liquid supply passage 21 is not limited to circular or round but may be rectangular or the like.

The second common liquid chamber 17 may be formed by dividing the grooved by a separation wall 30. As for the method of forming this, as shown in FIG. 23 which is an exploded perspective view, a common liquid chamber frame and a second liquid passage wall are formed of a dry film, and a combination of a grooved member 50 having the separation wall fixed thereto and the element substrate 1 are bonded, thus forming the second common liquid chamber 17 and the second liquid flow path 16.

In this example, the element substrate 1 is constituted by providing the supporting member 70 of metal such as aluminum with a plurality of electrothermal transducer elements as heat generating elements for generating heat for bubble generation from the bubble generation liquid through film boiling.

Above the element substrate 1, there are disposed the plurality of grooves constituting the liquid flow path 16 formed by the second liquid passage walls, the recess for constituting the second common liquid chamber (common bubble generation liquid chamber) 17 which is in fluid communication with the plurality of bubble generation liquid flow paths for supplying the bubble generation liquid to the bubble generation liquid passages, and the separation or dividing walls 30 having the movable walls 31.

Designated by reference numeral 50 is a grooved member. The grooved member is provided with grooves for constituting the ejection liquid flow paths (first liquid flow paths) 14 by mounting the separation walls 30 thereto, a recess for constituting the first common liquid chamber (common ejection liquid chamber) 15 for supplying the ejection liquid to the ejection liquid flow paths, the first supply passage (ejection liquid supply passage) 20 for supplying the ejection liquid to the first common liquid chamber, and the second supply passage (bubble generation liquid supply passage) 21 for supplying the bubble generation liquid to the second supply passage (bubble generation liquid supply passage) 21. The second supply passage 21 is connected with a fluid communication path in fluid communication with the second common liquid chamber 17, penetrating through the separation wall 30 disposed outside of the first common liquid chamber 15. By the provision of the fluid communication path, the bubble generation liquid can be supplied to the second common liquid chamber 15 without mixture with the ejection liquid.

The positional relation among the element substrate 1, separation wall 30, grooved top plate 50 is such that the movable members 31 are arranged corresponding to the heat generating elements on the element substrate 1, and that the ejection liquid flow paths 14 are arranged corresponding to the movable members 31. In this example, one second supply passage is provided for the grooved member, but it may be plural in accordance with the supply amount. The cross-sectional area of the flow path of the ejection liquid supply passage 20 and the bubble generation liquid supply passage 21 may be determined in proportion to the supply amount. By the optimization of the cross-sectional area of the flow path, the parts constituting the grooved member 50 or the like can be downsized.

As described in the foregoing, according to this embodiment, the second supply passage for supplying the second liquid to the second liquid flow path and the first supply passage for supplying the first liquid to the first liquid flow path, can be provided by a single grooved top plate, so that the number of parts can be reduced, and therefore, the reduction of the manufacturing steps and therefore the reduction of the manufacturing cost, are accomplished.

Furthermore, the supply of the second liquid to the second common liquid chamber in fluid communication with the second liquid flow path, is effected through the second liquid flow path which penetrates the separation wall for separating the first liquid and the second liquid, and therefore, one bonding step is enough for the bonding of the separation wall, the grooved member and the heat generating element substrate, so that the manufacturing is easy, and the accuracy of the bonding is improved.

Since the second liquid is supplied to the second liquid common liquid chamber, penetrating the separation wall, the supply of the second liquid to the second liquid flow path is assured, and therefore, the supply amount is sufficient so that the stabilized ejection is accomplished.

Ejection Liquid and Bubble Generation Liquid

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n- n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

| Dye ink viscosity of 2cp: | |
|---|---|
| (C.I. food black 2) dye | 3 wt. % |
| diethylene glycol | 10 wt. % |
| Thio diglycol | 5 wt. % |
| Ethanol | 5 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image.

| | |
|---|---|
| Bubble generation liquid 1: | |
| Ethanol | 40 wt. % |
| Water | 60 wt. % |
| Bubble generation liquid 2: | |
| Water | 100 wt. % |
| Bubble generation liquid 3: | |
| Isopropyl alcoholic | 10 wt. % |
| Water | 90 wt. % |
| Ejection liquid 1: (Pigment ink approx. 15 cp) | |
| Carbon black | 5 wt. % |
| Stylene-acrylate-acrylate ethyl copolymer resin material Dispersion material (oxide 140, weight average molecular weight) | 1 wt. % |
| Mono-ethanol amine | 0.25 wt. % |
| Glyceline | 69 wt. % |
| Thiodiglycol | 5 wt. % |
| Ethanol | 3 wt. % |
| Water | 16.75 wt. % |

-continued

| | |
|---|---|
| Ejection liquid 2 (55 cp): | |
| Polyethylene glycol 200 | 100 wt. % |
| Ejection liquid 3 (150 cp): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

Liquid Ejecting Device

Figure 29:
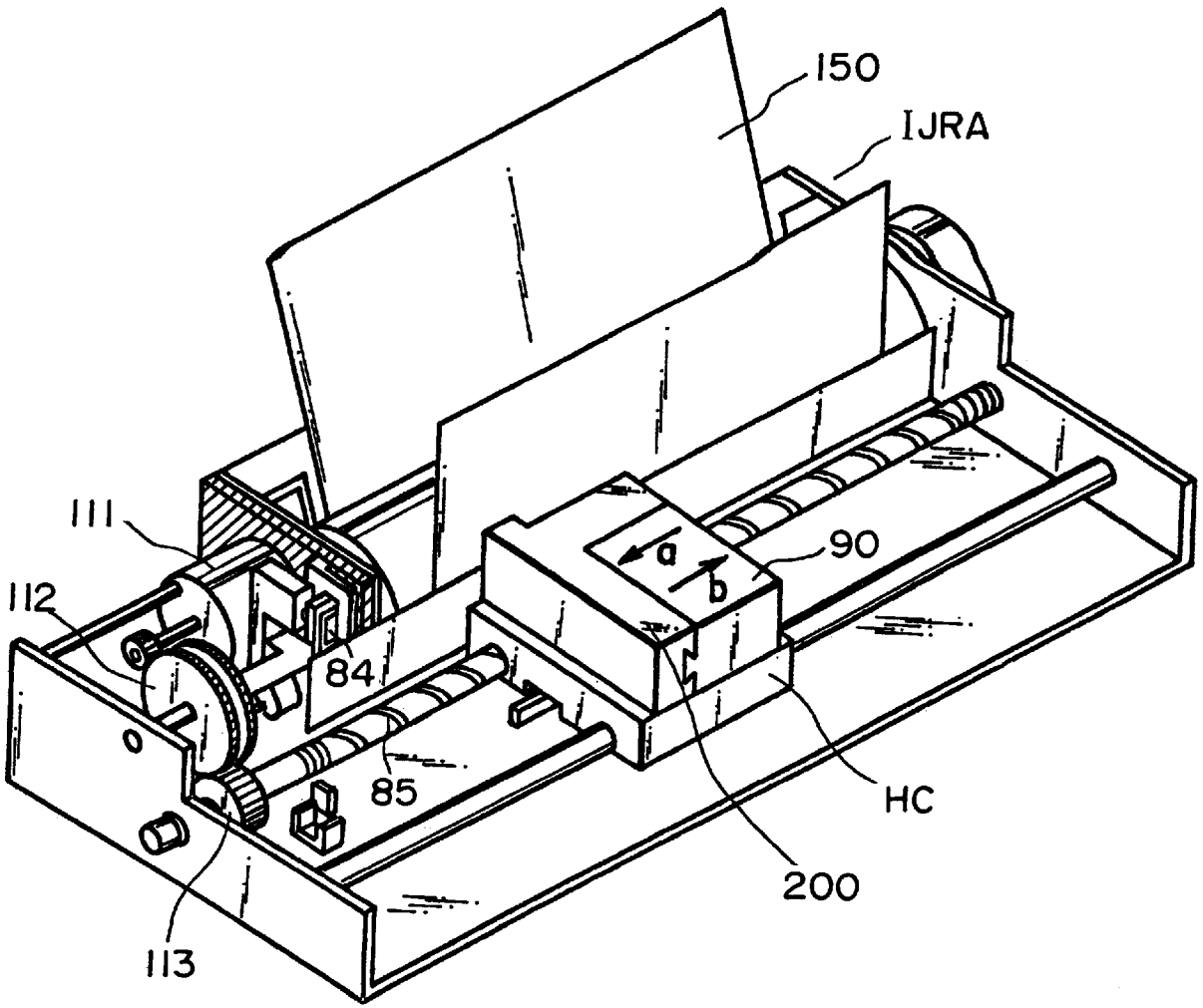
FIG. 29 is a schematic illustration of a liquid ejecting apparatus.

FIG. 29 is a schematic illustration of a liquid ejecting device used with the above-described liquid ejecting head. In this embodiment, the ejection liquid is ink, and the apparatus is an ink ejection recording apparatus. The liquid ejecting device comprises a carriage HC to which the head cartridge comprising a liquid container portion 90 and liquid ejecting head portion 200 which are detachably connectable with each other, is mountable. The carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head in response to the signal.

The liquid ejecting apparatus of this embodiment comprises a motor 111 as a driving source for driving the recording material transporting means and the carriage, gears 112, 113 for transmitting the power from the driving source to the carriage, and carriage shaft 115 and so on. By the recording device and the liquid ejecting method using this recording device, good prints can be provided by ejecting the liquid to the various recording material.

Figure 30:
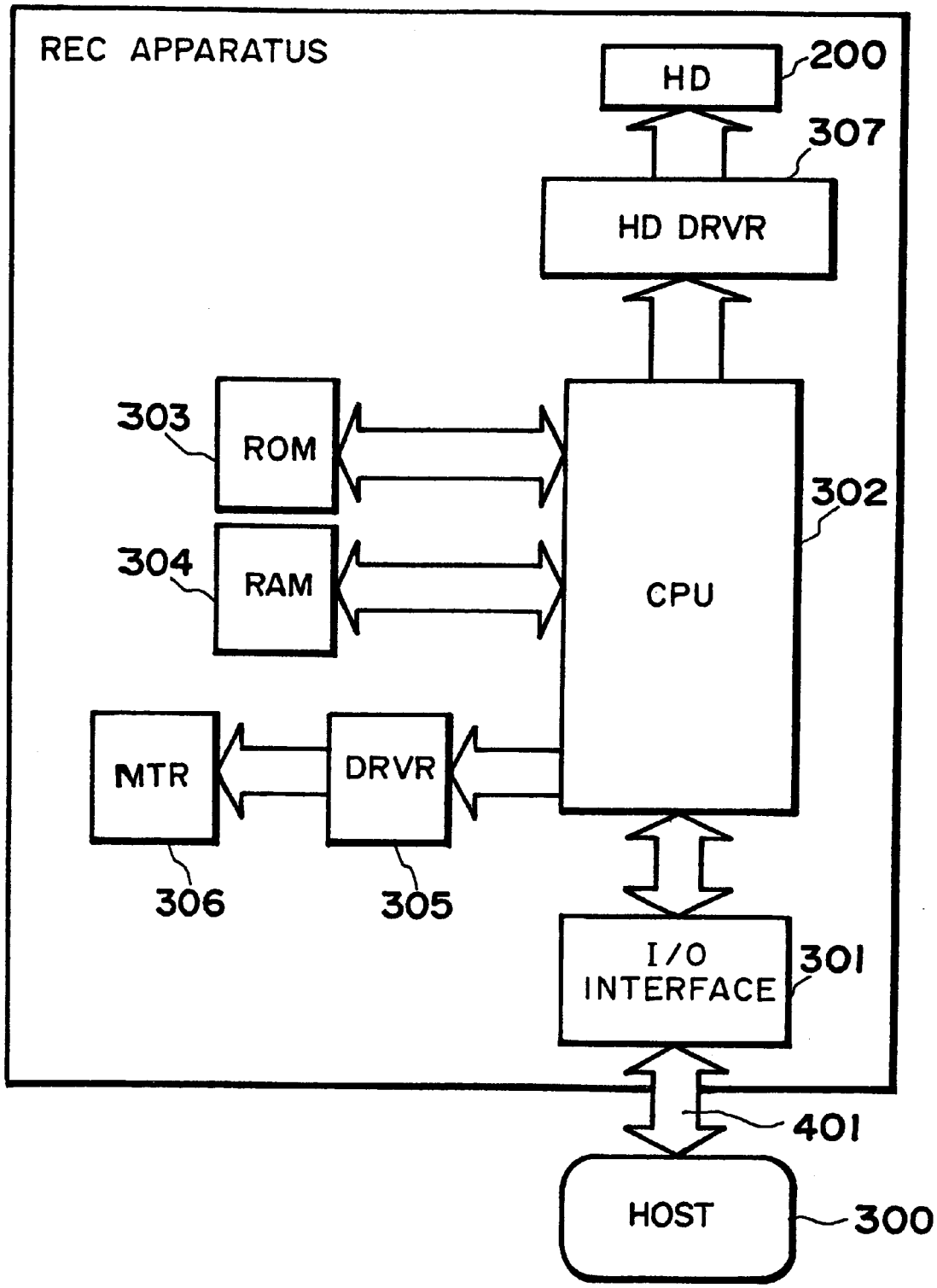
FIG. 30 is a block figure of an apparatus.
Figure 31A:
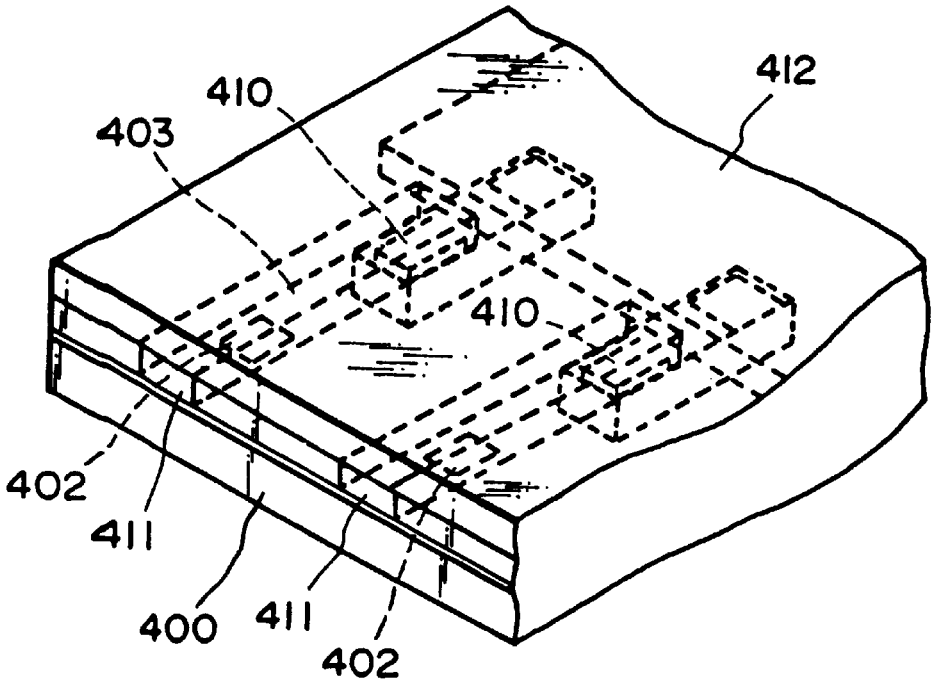
FIG. 31(a) PRIOR ART
FIG. 31, consisting of FIGS. 31(*a*) and 31(*b*), is an illustration of a liquid flow passage structure of a conventional liquid ejecting head.
Figure 31B:
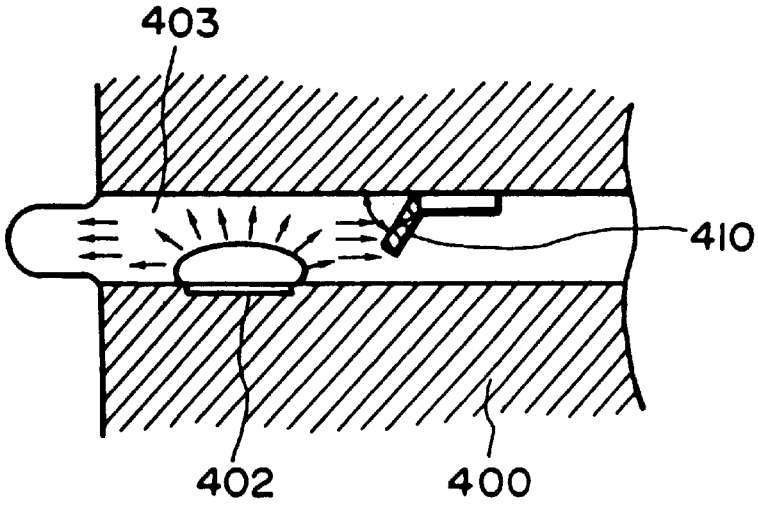
FIG. 31(b) PRIOR ART

FIG. 30 is a block diagram for describing the general operation of an ink ejection recording apparatus which employs the liquid ejection method, and the liquid ejection head, in accordance with the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

As for recording medium, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejecting head having at least a first and a second liquid ejecting head portions, said liquid ejecting head portions each comprising:

a plurality of ejection outlets for ejecting liquid;

a plurality of bubble generating regions for generating bubbles in the liquid; and a plurality of movable members each of which is displaceable between a first position and a second position farther from said bubble generating region than the first position;

wherein said movable member is displaced from said first position to said second position by a pressure produced by generation of the bubble in said bubble generating portion to permit expansion of the bubble more in a downstream side closer to the ejection outlet than in an upstream side;

wherein at least dimensions of said movable members of said first and second liquid electing head portions are different to provide different amount of ejections of the liquid by said first and second liquid ejecting head portions.

2. A liquid ejecting head according to claim 1, further comprising:

a plurality of supply passages for respectively supplying the liquid onto said bubble generating regions from an upstream of said bubble generating regions along said bubble generating regions;

and wherein the movable members are disposed facing to said bubble generating regions and have free ends at an ejection outlet side, wherein said free ends of said movable member are displaceable, on the basis of a pressure produced by generation of the bubble, to direct the pressure toward the ejection outlet side.

3. A liquid ejecting head according to claim 1, further comprising:

a plurality of supply passages for respectively supplying the liquid onto said bubble generating regions from an upstream of said movable member along a surface of said movable member closer to said bubble generating regions;

and wherein the movable members are disposed faced to said bubble generating regions and have free ends at an election outlet side, wherein said free ends of said movable members are displaceable, on the basis of a pressure produced by generation of the bubble, to direct the pressure toward the election outlet side.

4. A liquid ejecting head according to claim 1, further comprising:

a first liquid flow path in fluid communication with a given said ejection outlet;

a second liquid flow path having at least one said bubble generation region for generating the bubble in the liquid by applying heat to the liquid;

and wherein each of said movable members is disposed between said first liquid flow path and said bubble generation region and has a free end adjacent the ejection outlet, wherein when the free end of the movable member is displaced into said first liquid flow path by pressure produced by the generation of the bubble, pressure is guided toward the ejection outlet of said first liquid flow path by the displacement of the movable member to eject the liquid.

5. A liquid ejecting head according to claim 1, further comprising:

a grooved member integrally having said plurality of ejection outlets for ejecting the liquid, a plurality of grooves for forming a plurality of first liquid flow paths in direct fluid communication with said ejection outlets, and a recess for forming a first common liquid chamber for supplying the liquid to said first liquid flow paths;

an element substrate having the plurality of bubble generating regions for generating the bubble in the liquid by applying heat to the liquid; and a partition wall disposed between said grooved member and said element substrate and forming a part of walls of second liquid flow paths corresponding to said bubble generating regions, and wherein said movable members face said bubble generating regions.

6. A liquid ejection head according to claim 5, wherein said grooved member has a first introduction path for supplying the liquid to said first common liquid chamber and a second introduction path for supplying the liquid to said second common liquid chamber.

7. A liquid ejection head according to claim 5, wherein said grooved member has a plurality of said second introduction paths.

8. A liquid ejection head according to claim 5, wherein a ratio of a cross-sectional area of said first introduction path and a cross-sectional area of said second introduction path is proportional to a ratio of supply amounts of the liquids.

9. A liquid ejection head according to claim 5, wherein said second introduction path penetrates said partition wall to supply the liquid to said second common liquid chamber.

10. A liquid ejection head according to claim 5, wherein the liquid supplied to the first liquid flow path is the same as the liquid supplied to the second liquid flow path.

11. A liquid ejection head according to claim 5, wherein the liquid supplied to the first liquid flow path is different from the liquid supplied to the second liquid flow path.

12. A liquid ejection head according to claim 5, wherein the liquid in said second liquid flow path is lower in viscosity, higher in bubble generation property, or higher in thermal stability than the liquid in said first liquid flow path.

13. A liquid ejection head according to claim 1, wherein by the movement of the movable member, a downstream portion of the bubble grows toward downstream of the movable member.

14. A liquid ejection head according to claim 1, wherein the movable member has a fulcrum and a free end at a position downstream of the fulcrum.

15. A liquid ejection head according to claim 1, wherein said movable member is in the form of a plate.

16. A liquid ejection head according to claim 1, wherein said liquid ejecting head portions have said movable members of different configurations.

17. A liquid ejection head according to claim 1, wherein said liquid ejecting head portions include a first liquid ejecting head portion and a second liquid ejecting head portion, which are different.

18. A liquid ejection head according to claim 17, wherein said liquid ejecting head portions have diameters different from each other.

19. A liquid ejection head according to claim 18, wherein said liquid ejecting head portions have configurations of means for generating the bubble, which are different from each other.

20. A liquid ejection head according to claim 19, wherein said liquid ejecting head portions have relative positions of means for generating the bubble to said movable member, which are different from each other.

21. A liquid ejection head according to claim 19, wherein said liquid ejecting head portions include a first liquid ejecting head portion and a second liquid ejecting head portion, which are different.

22. A liquid ejection head according to claim 19, wherein said liquid ejecting head portion have more than two configurations of said movable members.

23. A liquid ejection head according to claim 1, wherein a heat generating element for generating the bubble is disposed faced to the movable member, and said bubble generation region is formed between the movable member and the heat generating element.

24. A liquid ejection head according to claim 23, wherein the movable member has a free end at a position downstream of the fulcrum.

25. A liquid ejection head according to claim 23, wherein said liquid flow path has a supply passage for supplying the liquid to said heat generating element from upstream thereof along the heat generating element.

26. A liquid ejection head according to claim 23, wherein the liquid is supplied to the heat generating element along an internal wall which is substantially flat or smoothly curved.

27. A liquid ejection head according to claim 23, wherein said bubble is generated by film boiling by applying, to the liquid, heat generated by said heat generating element.

28. A liquid ejection head according to claim 23, wherein all of effective bubble generation region of said heat generating element is faced to said movable member.

29. A liquid ejection head according to claim 23, wherein all of the surface of said heat generating element is faced to said movable member.

30. A liquid ejection head according to claim 23, wherein a total area of said movable member is larger than a total area of said heat generating element.

31. A liquid ejection head according to claim 23, wherein a fulcrum of said movable member is at a position out of a portion right above said heat generating element.

32. A liquid ejection head according to claim 23, wherein the free end of said movable member has a portion extending in a direction substantially perpendicular to the liquid flow path having said heat generating element.

33. A liquid ejection head according to claim 23, wherein said free end of said movable member is disposed at a position closer to said ejection outlet than said heat generating element.

34. A liquid ejection head according to claim 23, wherein said heat generating element includes an electrothermal transducer having a heat generating resistor for generating heat upon electric energization.

35. A liquid ejection head according to claim 34, wherein said electrothermal transducer has a protecting film on said heat generating resistor.

36. A liquid ejection head according to claim 34, further comprising an element substrate, and wherein said element substrate comprises a wiring for transmitting an electric signal to said electrothermal transducer, and a function element for selectively applying an electric signal to said electrothermal transducer.

37. A liquid ejection head according to claim 23, wherein said path along which the liquid flows has a chamber-like shape at a portion where said heat generating element is disposed.

38. A liquid ejection head according to claim 37, wherein said second flow path has a throat portion upstream of said heat generating element.

39. A liquid ejection head according to claim 23, wherein a distance between a surface of said heat generating element and said movable member, is not more than 30 $\mu$m.

40. A liquid ejection recording method comprising the step of:

providing a liquid ejecting head, the liquid ejecting head having at least a first and a second liquid ejecting head portions, the liquid ejecting head portions each comprising:

a plurality of ejection outlets for ejecting liquid, a plurality of bubble generating regions for generating bubbles in the liquid, and a plurality of movable members each of which is displaceable between a first position and a second position farther from said bubble generating region than the first position, wherein said movable member is displaced from said first position to said second position by a pressure produced by generation of the bubble in said bubble generating portion to permit expansion of the bubble more in a downstream side closer to the ejection outlet than in an upstream side, wherein at least dimensions of said movable members of said first and second liquid ejecting head portions are different to provide different amount of elections of the liquid by said first and second liquid ejecting head portions.

41. A liquid ejection apparatus comprising:

a liquid ejecting head having at least a first and a second liquid ejecting head portions, the liquid ejecting head portions each comprising:

a plurality of ejection outlets for ejecting liquid, a plurality of bubble generating regions for generating bubbles in the liquid, and a plurality of movable members each of which is displaceable between a first position and a second position farther from said bubble generating region than the first position, wherein said movable member is displaced from said first position to said second position by a pressure produced by generation of the bubble in said bubble generating portion to permit expansion of the bubble more in a downstream side closer to the ejection outlet than in an upstream side, wherein at least dimensions of said movable members of said first and second liquid ejecting head portions are different to provide different amount of ejections of the liquid by said first and second liquid ejecting head portions; and driving signal applying means for applying a signal to at least one of said bubble generating regions so that said at least one said bubble generating region ejects the liquid from the liquid ejection head.

42. A liquid ejection apparatus according to claim 41, wherein ink is ejected from said liquid ejecting head and is deposited on recording paper to effect recording thereon.

43. An apparatus according to claim 41, wherein recording liquid is ejected from said liquid ejecting head and is deposited on a textile recording medium to effect recording thereon.

44. An apparatus according to claim 41, wherein recording liquid is ejected from said liquid ejecting head and is deposited on a plastic resin material to effect recording thereon.

45. An apparatus according to claim 41, wherein recording liquid is ejected from said liquid ejecting head and is deposited on a metal to effect recording thereon.

46. An apparatus according to claim 41, wherein recording liquid is ejected from said liquid ejecting head and is deposited on a wooden material to effect recording thereon.

47. An apparatus according to claim 41, wherein recording liquid is ejected from said liquid ejecting head and is deposited on a leather material to effect recording thereon.

48. An apparatus according to claim 41, wherein different color recording liquids are ejected and are deposited on a recording material to effect recording thereon.

49. A liquid ejection apparatus comprising:

a liquid ejecting head having at least a first and a second liquid ejecting head portions, the liquid ejecting head portions each comprising:

a plurality of election outlets for ejecting liquid, a plurality of bubble generating regions for generating bubbles in the liquid, and a plurality of movable members each of which is displaceable between a first position and a second position farther from said bubble generating region than the first position, wherein said movable member is displaced from said first position to said second position by a pressure produced by generation of the bubble in said bubble generating portion to permit expansion of the bubble more in a downstream side closer to the election outlet than in an upstream side, wherein at least dimensions of said movable members of said first and second liquid ejecting head portions are different to provide different amount of ejections of the liquid by said first and second liquid ejecting head portions; and feeding means for feeding a recording material past the liquid ejecting head for receiving the liquid ejected from the liquid ejection head.

* * * * *

UNITED STATES PATENT AND TRADEMARK OFFICE

CERTIFICATE OF CORRECTION

PATENT NO. : 6,062,680
DATED : May 16, 2000
INVENTOR(S) : Aya Yoshihira et al.

It is certified that error appears in the above-identified patent and that said Letters Patent is hereby corrected as shown below:

Title page,
Item [30] FOREIGN APPLICATION PRIORITY DATA ;
"Jun. 7, 1996 [JP] Japan ..... 8-246262" should read -- Jun. 7, 1996 [JP] ..... 8-146262" --.
Item [57] ABSTRACT
Line 3, "includes" should read -- including --.

Sheet 16,
Figure 21, "HEATEA" should read -- HEATED --.

Column 1,
Line 16, "tion the" should read -- tion of the --;
Line 36, "resulted" should read -- resulting --;
Line 44, "with such" should read -- such --;
Line 51, "another" should read -- other --.

Column 2,
Line 6, "method" should read -- method of --;
Line 38, "accomplished," should read -- accomplished --;
Line 47, "some" should read -- same --;
Line 50, "field," should read -- fields, --.

Column 3,
Line 25, "reused" should read -- reuse --.

Column 5,
Line 4, "easily" should read -- easily be --;
Line 29, "produced," should read -- produce, --;
Line 37, "easy" should read -- easily --;
Line 66, "is illustrate" should read -- illustrates --.

Figure 8A:
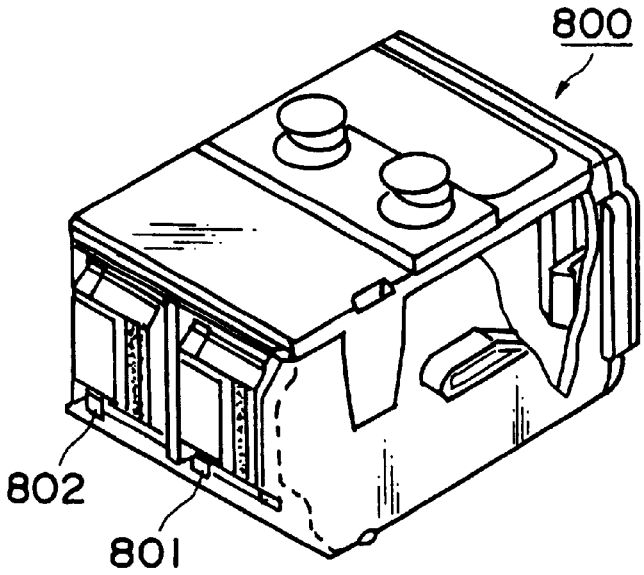
FIG. 8, consisting of FIGS. 8(*a*)–8(*c*) is an illustration of an example of a liquid ejecting head in the present invention, wherein (a) is a perspective view showing a schematic structure of a liquid ejecting head, (b) and perspective view are top plan views of a movable member.
Figure 8B:
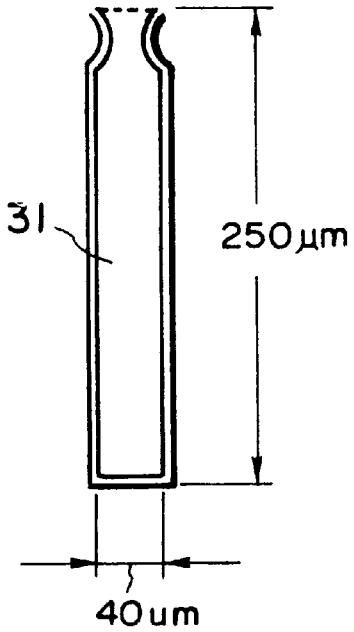
Figure 8C:
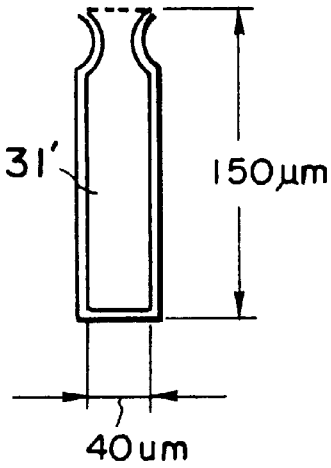

Column 6,
Line 17, "FIGS. 8(a)-8(c)" should read -- FIGS. 8(a)-8(c), --;
Line 19, "(b) and perspective view" should read -- (b) and (c) --;
Line 37, "FIGS. 14(a)-14(c)" should read -- FIGS. 14(a)-14(c), --.
Line 46, "FIG. 17" should read -- FIG. 17, --;
Line 50, "FIGS. 19a)-19(c)," should read -- FIGS. 19(a)-19(c), --.

UNITED STATES PATENT AND TRADEMARK OFFICE

CERTIFICATE OF CORRECTION

PATENT NO. : 6,062,680
DATED : May 16, 2000
INVENTOR(S) : Aya Yoshihira et al.

It is certified that error appears in the above-identified patent and that said Letters Patent is hereby corrected as shown below:

Column 7,
Line 52, "approx. as if covers" should read -- approx. covering --.

Column 8,
Line 15, "important" should read -- the important --;
Line 34, "of the is" should read -- is --;
Line 40, "since it" should read -- since it is --;
Line 50, "are toward" should read -- goes toward --;
Line 55, "to to" should read -- to --.

Column 9,
Line 14, "of of" should read -- of --.

Column 12,
Line 27, "this" should be deleted;
Line 38, "and" should read -- and the --;
Line 55, "an" should read -- a --.

Column 13,
Line 29, "an" should read -- a --;
Line 45, "is" should read -- are --;
Line 61, "an" should read -- a --.

Column 14,
Line 27, "an" should read -- a --;
Line 61, "an" should read -- a --.

Column 15,
Line 20, 1 50 μm" should read -- 150 μm --;
Line 63, "head 901," should read -- heads 901, --.

Column 16,
Line 38, "FIG. 12," should read -- FIG. 11, --.

Column 17,
Line 12, "anyone" should read -- of any kind --;
Line 20, "of fundamental concept" should read -- one of the fundamental concepts --.

UNITED STATES PATENT AND TRADEMARK OFFICE

CERTIFICATE OF CORRECTION

PATENT NO. : 6,062,680
DATED : May 16, 2000
INVENTOR(S) : Aya Yoshihira et al.

It is certified that error appears in the above-identified patent and that said Letters Patent is hereby corrected as shown below:

Column 18,
Line 9, "part upon" should read -- part. Upon --;
Line 32 and 67, "and ejection" should read -- and the ejection --.

Column 19,
Line 19, "FIG. 10, (b)" should read -- FIG. 14, (b) --.

Column 20,
Line 5, "th" should read -- the --;
Line 17, "As for the postitional relation" should read -- The positional relations --;
Line 56, "member as" should read -- member, and as --.

Column 21,
Line 9, "liquid" should read -- liquid is --;
Line 21, "embodiment, the" should read -- embodiment, and the --.

Column 22,
Line 57, "path 4" should read -- path 16 --.

Figures 20A, 20B, 20C:
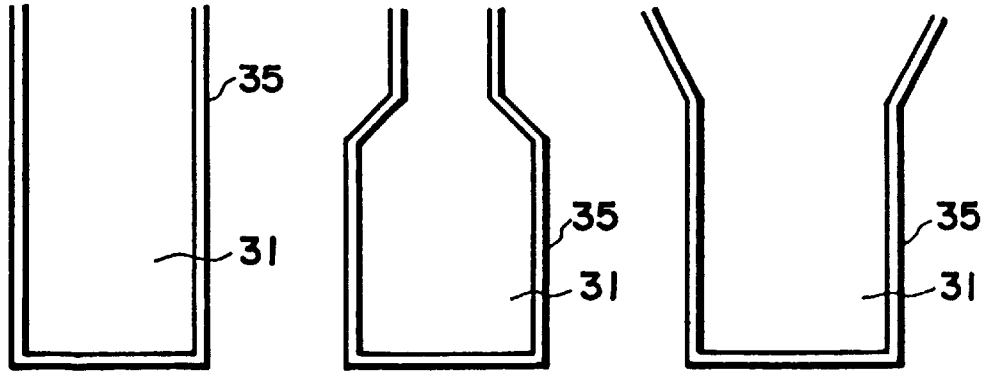
FIG. 20, consisting of FIGS. 20(*a*)–20(*c*), illustrates another configuration of a movable member.

Column 23,
Line 2, "FIG. 20 shows" should read -- FIGS. 20(a)-20(c) show --;
Line 5, "FIG. 15, (a)," should read -- FIG. 20, (a), --;
Line 27, 37 and 62 "alloy" should read -- alloys --;
Line 28, "nytril" should read -- nytrile --;
Line 33, "sulfon" should read -- sulfane --;
Line 49, 50 and 63, "compound" should read -- compounds --;

Column 24,
Line 36, "high" should read -- highly --;
Line 55, "of" (second occurrence) should read -- is --.

Column 25,
Line 11, "of" (second occurrence) should read -- is --;
Line 55, "area." should read -- areas. --.

UNITED STATES PATENT AND TRADEMARK OFFICE

CERTIFICATE OF CORRECTION

PATENT NO. : 6,062,680
DATED : May 16, 2000
INVENTOR(S) : Aya Yoshihira et al.

It is certified that error appears in the above-identified patent and that said Letters Patent is hereby corrected as shown below:

Column 26,
Line 29, "with" should read -- in --;
Line 60, "FIG. 25" should read -- FIG. 25 (a) --.

Figure 26:
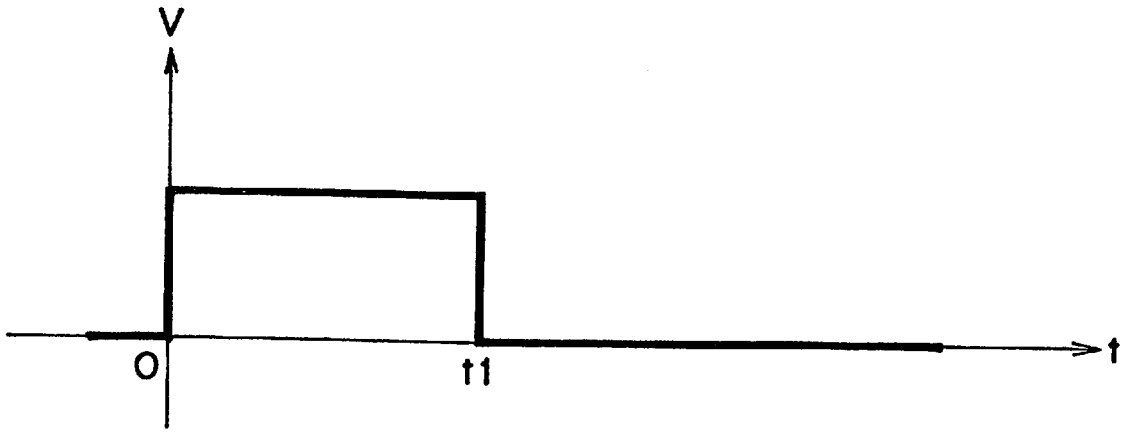
FIG. 26 is a schematic view showing a configuration of a driving pulse.

Column 27,
Line 14, "liquid" should read -- liquids --;
Line 40, "driving" should read -- driving of --;
Line 49, "FIG. 21" should read -- FIG. 26;
Line 63, "chamber," should read -- chambers, --;
Line 64, "reduces" should read -- reduced --.

Figure 28:
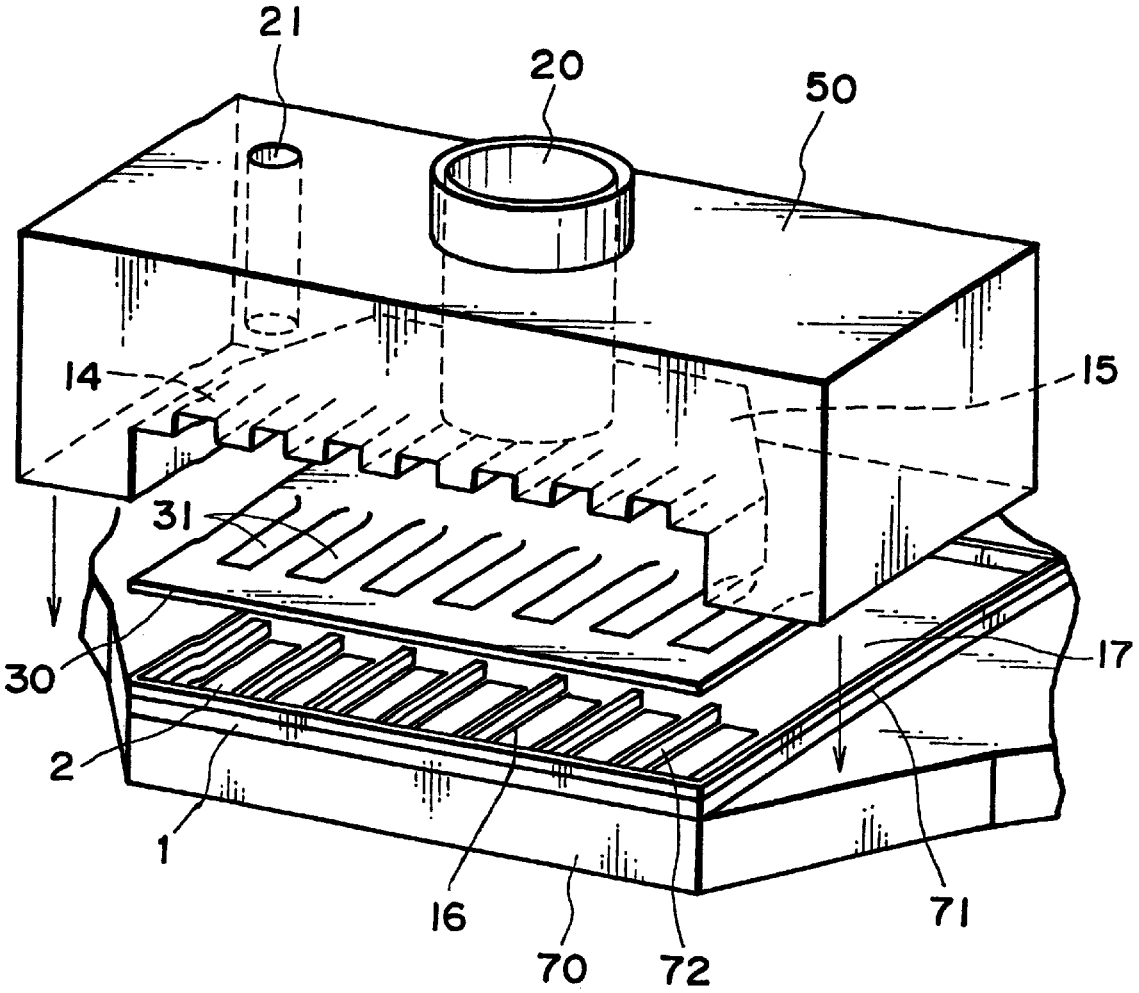
FIG. 28 is an exploded perspective view of a head of the present invention.

Column 28,
Line 36, "the grooved" should read -- the grooved member 50 --;
Line 37, "FIG. 23" should read -- FIG. 28 --;
Line 58, "movable walls 31." should read -- movable members 31. --.

Column 29,
Line 10, "chamber 15" should read -- chamber 17 --;
Line 43, "liquid" (second occurrence) should be deleted.

Column 30,
Line 1, "used, more" should read -- used. More --;
Line 2, "includes:" should read -- include: --;
Line 21, "is" should read -- are --;
Line 34, "Thio diglycol" should read -- Thiodiglycol --;
Line 55, "Isopropyl alcoholic" should read -- Isopropyl alcohol --.

Column 31,
Line 31, "cable" should read -- cal --;
Line 46, "material." should read -- materials. --.

Column 32,
Line 52, "amount" should read -- amounts --.

UNITED STATES PATENT AND TRADEMARK OFFICE

CERTIFICATE OF CORRECTION

PATENT NO. : 6,062,680
DATED : May 16, 2000
INVENTOR(S) : Aya Yoshihira et al.

It is certified that error appears in the above-identified patent and that said Letters Patent is hereby corrected as shown below:

Column 33,
Line 10 and 13, "election" should read -- ejection --;
Line 42, "walls" should read -- the walls --;
Line 44, "regions, and" should read -- regions; and --.

Column 34,
Line 37, "portion" should read -- portions --;
Line 50, "claim 23," should read -- claim 25, --.

Column 35,
Line 53, "amount of elections" should read -- amounts of ejections --.

Column 36,
Line 9, "amount" should read -- amounts --;
Line 44 and 55, "election" should read -- ejection --;
Line 59, "amount" should read -- amounts --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*